US011655114B2

(12) United States Patent
Fujita

(10) Patent No.: US 11,655,114 B2
(45) Date of Patent: May 23, 2023

(54) SHEET CONVEYING DEVICE AND IMAGE FORMING APPARATUS INCORPORATING THE SHEET CONVEYING DEVICE

(71) Applicant: Akihiro Fujita, Kanagawa (JP)

(72) Inventor: Akihiro Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 252 days.

(21) Appl. No.: 16/889,815

(22) Filed: Jun. 2, 2020

(65) Prior Publication Data

US 2020/0391966 A1 Dec. 17, 2020

(30) Foreign Application Priority Data

Jun. 14, 2019 (JP) ..... JP2019-111589

(51) Int. Cl.
*B65H 5/06* (2006.01)

(52) U.S. Cl.
CPC ..... *B65H 5/062* (2013.01)

(58) Field of Classification Search
CPC ..... B65H 1/14; B65H 2404/144; B65H 2404/1442; B65H 2407/21; B65H 5/26
See application file for complete search history.

(56) References Cited

U.S. PATENT DOCUMENTS 5,884,860 A 3/1999 Ishikawa et al.
6,079,708 A 6/2000 Fujita
8,894,060 B2 * 11/2014 Takamori ..... B65H 7/06 271/273
9,206,006 B2 * 12/2015 Okabe ..... B65H 5/062
9,266,692 B2 * 2/2016 Nakamura ..... B65H 9/006
2005/0194730 A1 9/2005 Nishida et al.
2005/0253323 A1 11/2005 Fujita et al.
2008/0122161 A1 5/2008 Fujita
2010/0149299 A1 6/2010 Nishida et al.
2013/0113157 A1 5/2013 Fujita

FOREIGN PATENT DOCUMENTS

JP 5-058508 3/1993
JP H07-206192 A 8/1995
JP 2005-089009 4/2005

OTHER PUBLICATIONS

Office Action dated Feb. 3, 2023 in Japanese Patent Application No. 2019-111589, 5 pages.

* cited by examiner

*Primary Examiner* — Howard J Sanders
(74) *Attorney, Agent, or Firm* — Xsensus LLP

(57) ABSTRACT

A sheet conveying device includes a first sheet conveyance passage, a second sheet conveyance passage, a pair of sheet conveying rollers, and a movable member. The second sheet conveyance passage is different from the first sheet conveyance passage. The pair of sheet conveying rollers includes two rollers configured to hold a sheet passing the first sheet conveyance passage. The movable member is configured to convey the sheet passing the second sheet conveyance passage. The two rollers are configured to be separated from each other along with movement of the movable member.

11 Claims, 16 Drawing Sheets

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2019-111589, filed on Jun. 14, 2019, in the Japan Patent Office, the entire disclosure of which is hereby incorporated by reference herein.

BACKGROUND

Technical Field

This disclosure relates to a sheet conveying device and an image forming apparatus incorporating the sheet conveying device.

Discussion of the Background Art

Various types of sheet conveying devices are known to convey a sheet in one sheet conveyance passage out of a plurality of sheet conveyance passages.

SUMMARY

At least one aspect of this disclosure provides a sheet conveying device including a first sheet conveyance passage, a second sheet conveyance passage, a pair of sheet conveying rollers, and a movable member. The second sheet conveyance passage is different from the first sheet conveyance passage. The pair of sheet conveying rollers includes two rollers configured to hold a sheet passing the first sheet conveyance passage. The movable member is configured to convey the sheet passing the second sheet conveyance passage. The two rollers are configured to be separated from each other along with movement of the movable member.

Further, at least one aspect of this disclosure provides an image forming apparatus including an image forming device configured to form an image on a sheet, and the above-described sheet conveying device configured to convey the sheet from the image forming device.

BRIEF DESCRIPTION OF THE SEVERAL VIEWS OF THE DRAWINGS

An exemplary embodiment of this disclosure will be described in detail based on the following figured, wherein.

Figure 1:
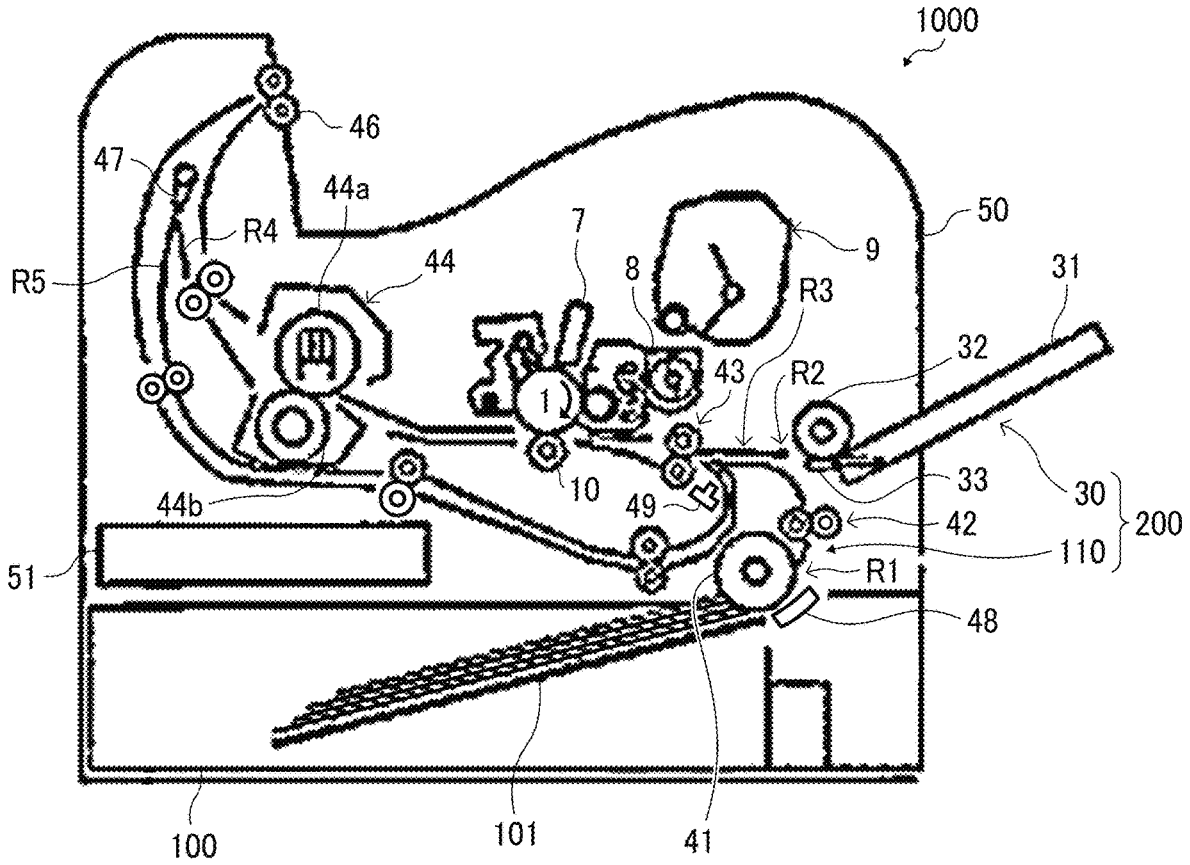
FIG. 1 is a schematic diagram illustrating an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Now, a description is given of an electrophotographic printer that functions as an electrophotographic image forming apparatus for forming images by electrophotography.

At first, a description is given of a basic configuration of an image forming apparatus 1000 according to an embodiment of this disclosure, with reference to FIG. 1.

FIG. 1 is a schematic diagram illustrating the image forming apparatus 1000 according to an embodiment of this disclosure.

In FIG. 1, the image forming apparatus 1000 according to the present embodiment of this disclosure includes a housing 50, a photoconductor 1, and a sheet tray 100. The photoconductor 1 functions as an image bearer or a latent image bearer. The sheet tray 20 functions as a sheet container that is detachably attachable to the housing 50. The sheet tray 100 contains a plurality of recording sheets S as a sheet bundle that includes a recording sheet S.

As a sheet feed roller 41 is driven to rotate, the recording sheet S is fed from the sheet tray 100. When a plurality of recording sheets S is fed from the sheet tray 100, an uppermost recording sheet S alone is separated from the other recording sheets S in a sheet separation nip region formed between the sheet feed roller 41 and a sheet separation pad 48, and is continuously conveyed toward downstream in a sheet conveyance direction in which the recording sheet S is conveyed. Then, the recording sheet S (i.e., the uppermost recording sheet S) reaches a regular sheet conveyance passage R1 that functions as a first sheet conveyance passage. Thereafter, the recording sheet S is gripped (held) in a sheet conveyance nip region formed by a pair of relay rollers 42 that functions as a pair of upper conveyance rollers, so that the recording sheet S is conveyed from upstream toward downstream in the sheet conveyance direction in the regular sheet conveyance passage R1. Note that the pair of conveyance rollers may be a pair of conveyance bodies, at least one of which is a belt.

The downstream end of the regular sheet conveyance passage R1 communicates with a common sheet conveyance passage R3. A pair of registration rollers 43 is provided in the common sheet conveyance passage R3. A registration sensor 49 that detects the recording sheet S is provided in the common sheet conveyance passage R3, being disposed upstream from the pair of registration rollers 43 in the sheet conveyance direction. When the recording sheet S reaches the pair of registration rollers 43, the recording sheet S is stopped temporality in a state in which the leading end of the recording sheet S is in contact with the registration nip region of the pair of registration rollers 43 that is stopped. While the leading end of the recording sheet S contacts the pair of registration rollers 43, skew of the recording sheet S is corrected. The registration sensor 49 is also used for an initial operation and a confirmation operation to check whether there is a remaining recording sheet S when canceling an abnormal stop of the image forming apparatus 1000.

The pair of registration rollers 43 starts rotating in synchrony with conveyance of the recording sheet S at a timing at which the recording sheet S contacts the surface of the photoconductor 1 to receive a toner image on the surface of the photoconductor 1 in the sheet transfer nip region. Then, the recording sheet S is conveyed toward the sheet transfer nip region. At this time, the pair of relay rollers 42 starts rotating simultaneously with the start of rotation of the pair of relay rollers 42, so as to start conveyance of the recording sheet S that has been temporarily stopped.

The image forming apparatus 1000 includes a bypass sheet feeder 30 in the housing 50. The bypass sheet feeder 30 includes a bypass sheet tray 31, a bypass sheet feed roller 32, a sheet separation pad 33, a bypass bottom plate 34, and a bypass bottom plate cam 35. A detailed description of the bypass sheet feeder 30 is given below. The recording sheet S placed on the bypass sheet tray 31 of the bypass sheet feeder 30 is fed from the bypass sheet tray 31 along with rotation of the bypass sheet feed roller 32 that functions as a sheet feed roller to feed the recording sheet S, to a bypass sheet conveyance passage R2 that functions as a second sheet conveyance passage. The downstream end of the bypass sheet conveyance passage R2 meets with the regular sheet conveyance passage R1, eventually being merged to the common sheet conveyance passage R3. The recording sheet S fed out by the bypass sheet feed roller 32 passes the sheet separation nip region formed by contact of the bypass sheet feed roller 32 and the sheet separation pad 33 in the bypass sheet conveyance passage R2. Then, the recording sheet S is conveyed to the common sheet conveyance passage R3 to be conveyed to the pair of registration rollers 43. Thereafter, similar to the recording sheet S fed from the sheet tray 100, the recording sheet S fed from the bypass sheet tray 31 passes the pair of registration rollers 43 to be conveyed to the transfer nip region.

Figure 2:
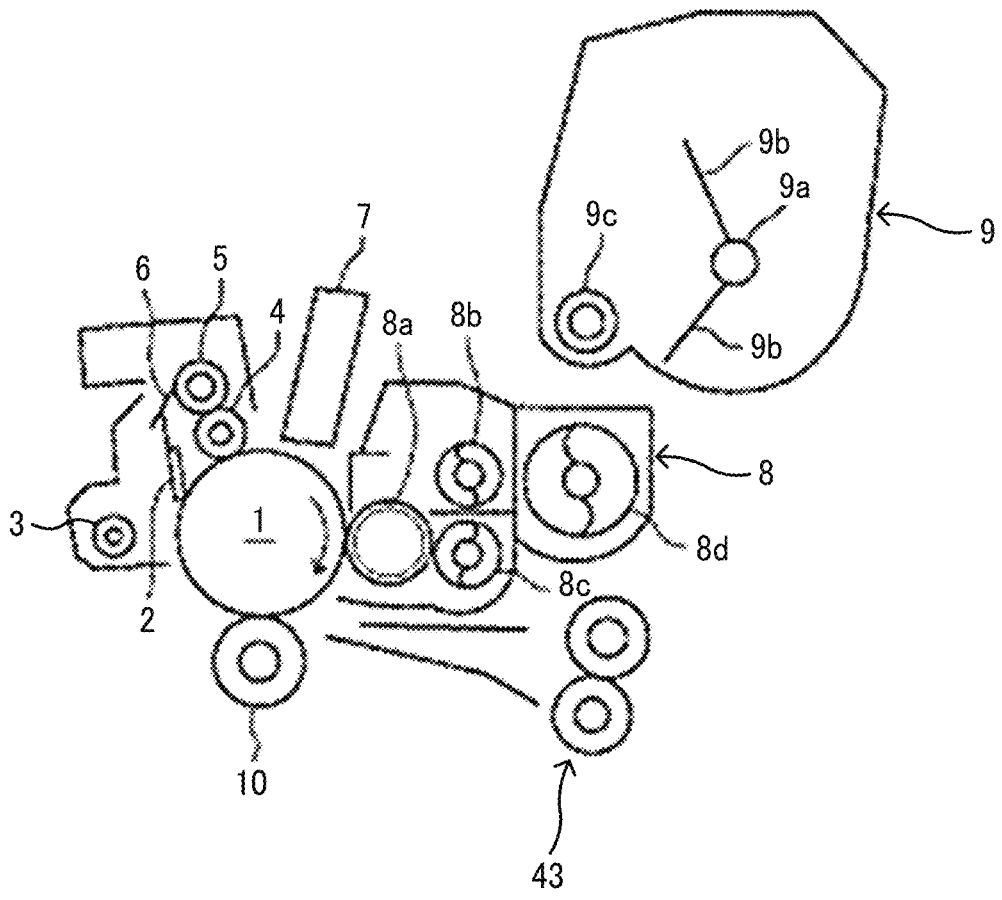
FIG. 2 is an enlarged view illustrating an image forming mechanism including a photoconductor and image forming units disposed around the photoconductor included in the image forming apparatus of FIG. 1.

FIG. 2 is an enlarged view illustrating an image forming mechanism including the photoconductor 1 and the image forming units disposed around the photoconductor 1 included in the image forming apparatus 1000.

To be more specific, a cleaning blade 2, a toner collection screw 3, a charging roller 4, a charging roller cleaning roller 5, a scraper 6, a latent image writing device 7, a developing device 8, and a transfer roller 10 are provided as the image forming units around the drum-shaped photoconductor 1 which is rotated clockwise in FIG. 2. The photoconductor 1 and the image forming units integrally function as an image forming device. The charging roller 4 includes a conductive rubber roller and forms a charging nip region by rotating while contacting the photoconductor 1. The charging roller 4 is applied with a charging bias that is output from a power source for the charging roller 4. As a result, the surface of the photoconductor 1 is uniformly charged by the charging bias generated between the surface of the photoconductor 1 and the surface of the charging roller 4 in the charging nip region.

The latent image writing device 7 includes an LED (light-emitting diode) array and performs light scanning with LED light over the surface of the photoconductor 1 that has been uniformly charged. As the latent image writing device 7 emits laser light beams onto the charged surface of the photoconductor 1, the electric potential of the irradiated (exposed) region of the charged surface of the photoconductor 1 attenuate, so that an electrostatic latent image is formed on the surface of the photoconductor 1.

As the photoconductor 1 rotates, the electrostatic latent image passes through a development region that formed between the surface of the photoconductor 1 and the developing device 8 when the photoconductor 1 is brought to face the developing device 8. The developing device 8 includes a developer circulation conveyance portion and a developing portion. The developer circulation conveyance portion includes developer that contains non-magnetic toner and magnetic carriers. The developer circulation conveyance portion includes a first screw 8*b* for conveying the developer to be supplied to a developing roller 8*a*, a second screw 8*c* for conveying the developer in an independent space positioned beneath the first screw 8*b*. The developer circulation conveyance portion further includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

As the first screw 8*b* rotates, the first screw 8*b* conveys the developer from a far side toward a near side in a direction perpendicular to the drawing sheet of FIG. 2. At this time, the first screw 8*b* supplies a portion of the developer to the developing roller 8*a* that is disposed opposite to the first screw 8*b*. The developer having been conveyed by the first screw 8*b* to the vicinity of a far end portion of the first screw 8*b* in the direction perpendicular to the drawing sheet of FIG. 2 is dropped onto the second screw 8*c*.

While receiving used developer from the developing roller 8*a*, the second screw 8*c* conveys the received developer from the far side toward the near side in the direction perpendicular to the drawing sheet of FIG. 2, along with rotation of the second screw 8*c*. The developer conveyed by the second screw 8*c* to the vicinity of a near end portion of the second screw 8*c* in the direction perpendicular to the drawing sheet of FIG. 2 is supplied to the inclined screw 8*d*. Further, along with rotation of the inclined screw 8*d*, the developer is conveyed from the far side toward the near side in the direction perpendicular to the drawing sheet of FIG. 2. Thereafter, the developer is supplied to the first screw 8*b* in the vicinity of the far end portion of the first screw 8*b* in the direction perpendicular to the drawing sheet of FIG. 2.

The developing roller 8*a* includes a developing sleeve and a magnet roller. The developing sleeve is a tubular-shaped rotatable non-magnetic member. The magnet roller is fixed to the developing sleeve in such a way as not to rotate together with the developing sleeve. Part of the developer that is conveyed by the first screw 8*b* is scooped up by the surface of the developing sleeve due to magnetic force generated by the magnet roller. The developer, which is carried onto the surface of the developing sleeve, is conveyed along with rotation of the developing sleeve and passes through an opposing position at which the developing sleeve and a doctor blade are disposed facing each other. According to this structure, the thickness of a layer of the developer on the surface of the developing sleeve is regulated while the developer is rotated together with rotation of the surface of the development sleeve. Thereafter, the developing roller 8*a* moves (rotates) while sliding on the surface of the photoconductor 1 in a development region in which the developing roller 8*a* is brought to face the photoconductor 1.

A development bias having the same polarity as the toner and as a uniformly charged electric potential (a background electric potential) on the surface of the photoconductor 1 is applied to the developing sleeve. The absolute value of this development bias is greater than the absolute value of the electric potential of the latent image and is smaller than the absolute value of the background electric potential on the background surface of the photoconductor 1. Therefore, in the development region, a development potential acts between the electrostatic latent image formed on the photoconductor 1 and the developing sleeve of the developing device 8 in such a way as to electrostatically move the toner from the developing sleeve to the electrostatic latent image on the surface of the photoconductor 1. By contrast, a background potential acts between the background surface of the photoconductor 1 and the development sleeve of the developing device 8 to electrostatically move the toner from the photoconductor 1 to the developing sleeve. This action of the background potential causes the toner to selectively adhere to the electrostatic latent image formed on the surface of the photoconductor 1, so that the electrostatic latent image is developed in the development region.

The developer that has passed through the development region enters an opposite region in which the developing sleeve faces the second screw 8*c* as the developing sleeve rotates. In the opposite region, a repulsive magnetic field is formed by two magnetic poles having polarities different from each other out of multiple magnetic poles included in the magnet roller. The developer that has entered the opposite region is separated from the surface of the developing sleeve due to the effect of the repulsive magnetic field and is collected by the second screw 8*c*.

The developer that is conveyed by the inclined screw 8*d* contains the developer that has been collected from the developing roller 8*a*, and this collected developer is contributed to development in the development region, so that the toner concentration is lowered. The developing device 8 includes a toner concentration sensor that detects the toner concentration of the developer to be conveyed by the inclined screw 8*d*. Based on detection results obtained by the toner concentration sensor, a controller 51 that functions as circuitry outputs a replenishment operation signal for replenishing the toner to the developer that is conveyed by the inclined screw 8*d*, as required.

A toner cartridge 9 is disposed above the developing device 8. The toner cartridge 9 contains toner and agitates the toner with agitators 9*b* fixed to a rotary shaft 9*a*. Further, a toner replenishment member 9*c* is driven to rotate according to the replenishment operation signal output from the controller 51. With this operation, an amount of the toner corresponding to a rotation amount of the toner replenishment member 9*c* is replenished to the inclined screw 8*d* of the developing device 8.

The toner image formed on the surface of the photoconductor 1 as a result of the development by the developing device 8 enters the transfer nip region where the photoconductor 1 and the transfer roller 10 contact each other along with rotation of the photoconductor 1. An electric bias having the opposite polarity to the latent image electric potential of the photoconductor 1 is applied to the transfer roller 10. Accordingly, a transfer bias is formed within the transfer nip region.

As described above, the pair of registration rollers 43 conveys the recording sheet S toward the transfer nip region in synchrony with a timing at which the toner image formed on the photoconductor 1 is overlaid onto the sheet S in the transfer nip region. Due to the transfer bias and the nip pressure, as the recording sheet S is brought to closely contact with the toner image formed on the photoconductor 1 at the transfer nip region, the toner image is transferred onto the recording sheet S.

Residual toner that is not transferred onto the recording sheet S remains on the surface of the photoconductor 1 after having passed through the transfer nip region. After being scraped off from the surface of the photoconductor 1 by the cleaning blade 2 that is in contact with the photoconductor 1, the residual toner is conveyed by the toner collection screw 3, toward a waste toner bottle.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 remain on the charging roller 4 that is in contact with the surface of the photoconductor 1. These foreign materials are shifted to the charging roller cleaning roller 5 that is in contact with the charging roller 4, and then are scraped off from the surface of the charging roller cleaning roller 5 by the scraper 6 that is in contact with the charging roller cleaning roller 5. The foreign materials scraped off from the surface of the charging roller cleaning roller 5 falls onto the toner collection screw 3.

In FIG. 1, the recording sheet S, which has passed through the transfer nip region formed by the photoconductor 1 and the transfer roller 10 contacting each other, is conveyed to a fixing device 44. The fixing device 44 includes a fixing roller 44*a* and a pressure roller 44*b*. The fixing roller 44*a* includes a heat generating source such as a halogen lamp. The pressure roller 44*b* is pressed against the fixing roller 44*a*. The fixing roller 44*a* and the pressure roller 44*b* contact each other to form a fixing nip region. The toner image is fixed to the surface of the recording sheet S that is held in the fixing nip region due to application of heat and pressure. Thereafter, the recording sheet S that has passed through the fixing device 44 passes through a sheet ejection passage R4. Then, the recording sheet S is held in a sheet ejection nip region formed by a pair of sheet ejection rollers 46.

The image forming apparatus 1000 switches printing modes between a single-side printing mode for performing single-side printing and a duplex printing mode for performing duplex printing. In the single-side printing mode, the image forming apparatus 1000 produces an image on one side of the recording sheet S. By contrast, the image forming apparatus 1000 prints respective images on both sides of the recording sheet S in the duplex printing mode. In the single-side printing mode or in the duplex printing mode in which images are formed on both sides of the recording sheet S, the pair of sheet ejection rollers 46 continues rotating in a forward direction and a reverse direction alternately, so that the recording sheet S in the sheet ejection passage R4 is ejected out of the image forming apparatus 1000. After passing through the fixing device 44, the recording sheet S is stacked on a sheet stacker provided on the top face of the housing 50 of the image forming apparatus 1000.

By contrast, in the duplex printing mode when an image is formed on one side of the recording sheet S, the pair of sheet ejection rollers 46 is rotated in the reverse direction at the timing at which the trailing end of the recording sheet S enters the sheet ejection nip region of the pair of sheet ejection rollers 46. At this time, a switching claw 47 disposed near the downstream end of the sheet ejection passage R4 moves to block (close) the sheet ejection passage R4 and open an entrance of a reverse conveyance passage R5 at the same time. As the recording sheet S starts reversing by the reverse rotation of the pair of sheet ejection rollers 46, the recording sheet S is conveyed to the reverse sheet conveyance passage R5. The downstream end of the reverse sheet conveyance passage R5 meets the common sheet conveyance passage R3 on the upstream side from the pair of registration rollers 43 in the sheet conveyance direction. After being conveyed in the reverse sheet conveyance passage R5, the recording sheet S is conveyed to the pair of registration rollers 43 in the common sheet conveyance passage R3 again. Then, after a toner image has been formed on the other side of the recording sheet S in the transfer nip region, the recording sheet S passes through the fixing device 44, the sheet ejection passage R4, and the pair of sheet ejection rollers 46 and is then ejected to the outside of the housing 50 of the image forming apparatus 1000.

Next, a description is given of the configuration and operations of a sheet conveying device that conveys the recording sheet S.

Figure 3:
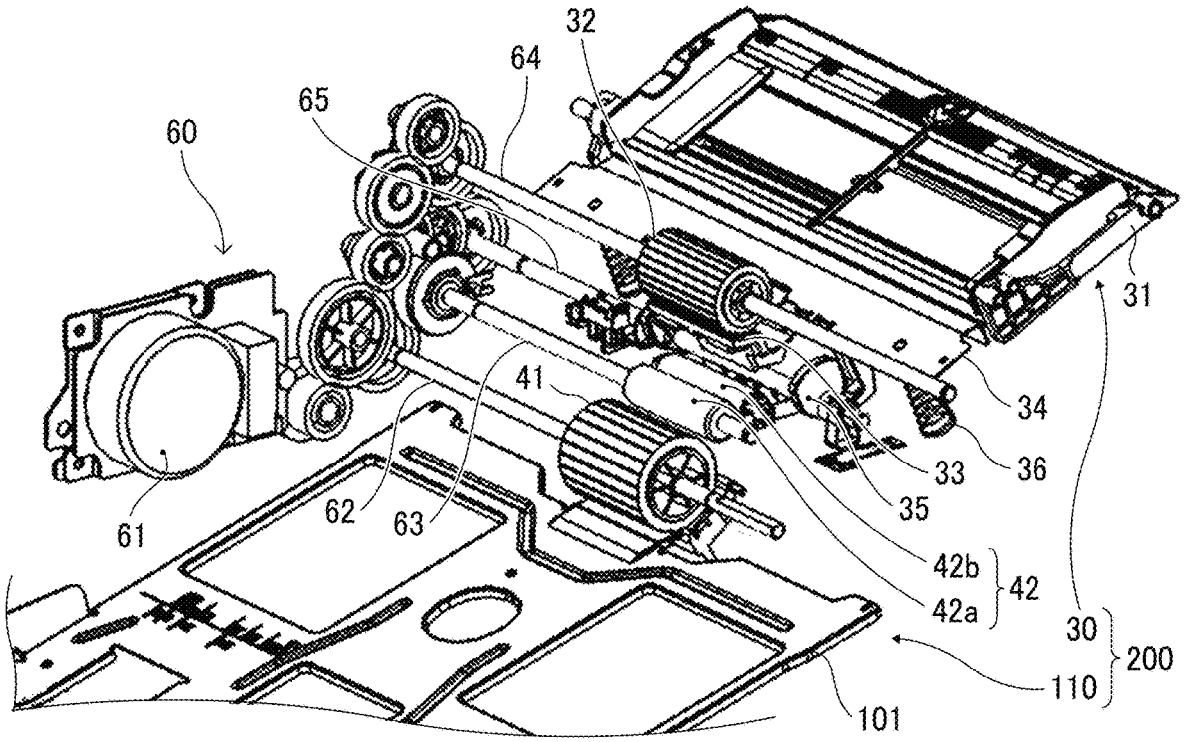
FIG. 3 is a perspective view illustrating a main configuration of a sheet conveying device including a regular sheet feeder to feed a recording sheet from a sheet tray and a bypass sheet feeder to feed a recording sheet from a bypass sheet tray in the image forming apparatus.

FIG. 3 is a perspective view illustrating the main configuration of a sheet conveying device 200 including a regular sheet feeder 110 to feed a recording sheet S from the sheet tray 100 a bypass sheet feeder 30 to feed a recording sheet S from the bypass sheet tray 31 in the image forming apparatus 1000.

Figure 4:
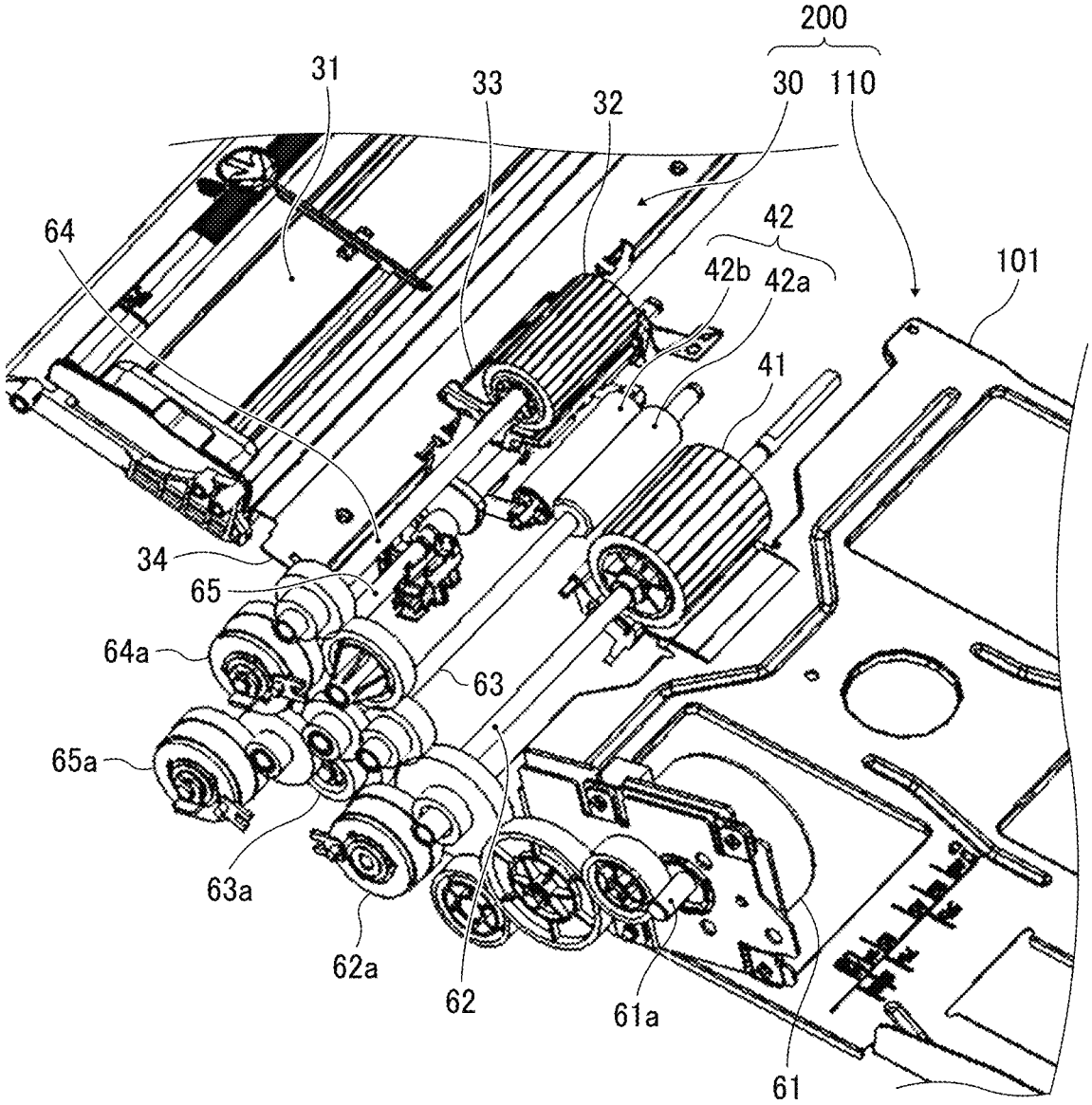
FIG. 4 is a perspective view illustrating a configuration of a drive mechanism in the sheet conveying device for driving the regular sheet feeder and the bypass sheet feeder.

FIG. 4 is a perspective view illustrating a configuration of a drive mechanism in the sheet conveying device 200 for driving the regular sheet feeder 110 and the bypass sheet feeder 30.

As illustrated in FIGS. 3 and 4, the drive mechanism of the regular sheet feeder 110 and the bypass sheet feeder 30 has a configuration in which a single main motor 61 applies driving force to be transmitted (distributed) to the sheet feed roller 41, the pair of relay rollers 42, the bypass sheet feed roller 32, and the bypass bottom plate cam 35. To be more specific, the driving force output from a motor shaft 61*a* of the main motor 61 that functions as a drive source is transmitted, via various idler gears, to a sheet feed roller shaft 62 mounted on the sheet feed roller 41, a relay roller shaft 63 mounted on the pair of relay rollers 42, a bypass sheet feed roller shaft 64 mounted on the bypass sheet feed roller 32, and a bypass bottom plate cam shaft 65 mounted on the bypass bottom plate cam 35. In other words, the sheet feed roller shaft 62, the relay roller shaft 63, the bypass sheet feed roller shaft 64, and the bypass bottom plate cam shaft 65 receive the driving force from the motor shaft 61*a* of the main motor 61.

The sheet feed roller shaft 62, the relay roller shaft 63, the bypass sheet feed roller shaft 64, and the bypass bottom plate cam shaft 65 includes respective clutches, which are a regular sheet feed clutch 62*a*, a relay clutch 63*a*, a bypass sheet feed clutch 64*a*, and a bypass sheet bottom plate cam clutch 65*a* to turn on and off transmission of the driving force. When the regular sheet feed clutch 62*a*, the relay clutch 63*a*, the bypass sheet feed clutch 64*a*, and the bypass sheet bottom plate cam clutch 65*a* are turned on (energized), the driving force is transmitted to rotate the sheet feed roller shaft 62, the relay roller shaft 63, the bypass sheet feed roller shaft 64, and the bypass bottom plate cam shaft 65, respectively. On the other hand, when the regular sheet feed clutch 62*a*, the relay clutch 63*a*, the bypass sheet feed clutch 64*a*, and the bypass sheet bottom plate cam clutch 65*a* are turned off, the driving force is not transmitted (transmission of the driving force is blocked), and therefore the sheet feed roller shaft 62, the relay roller shaft 63, the bypass sheet feed roller shaft 64, and the bypass bottom plate cam shaft 65 are not rotated. Note that the driving force of the main motor 61 is also transmitted to the pair of registration rollers 43 via a registration clutch for the pair of registration rollers 43. In the present embodiment, the controller 51 controls turning on and off of each clutch (i.e., the regular sheet feed clutch 62*a*, the relay clutch 63*a*, the bypass sheet feed clutch 64*a*, and the bypass sheet bottom plate cam clutch 65*a*) using the driving force of the main motor 61, so as to perform conveyance of the recording sheet S. In other words, the controller 51 controls conveyance of the recording sheet S.

Figure 5:
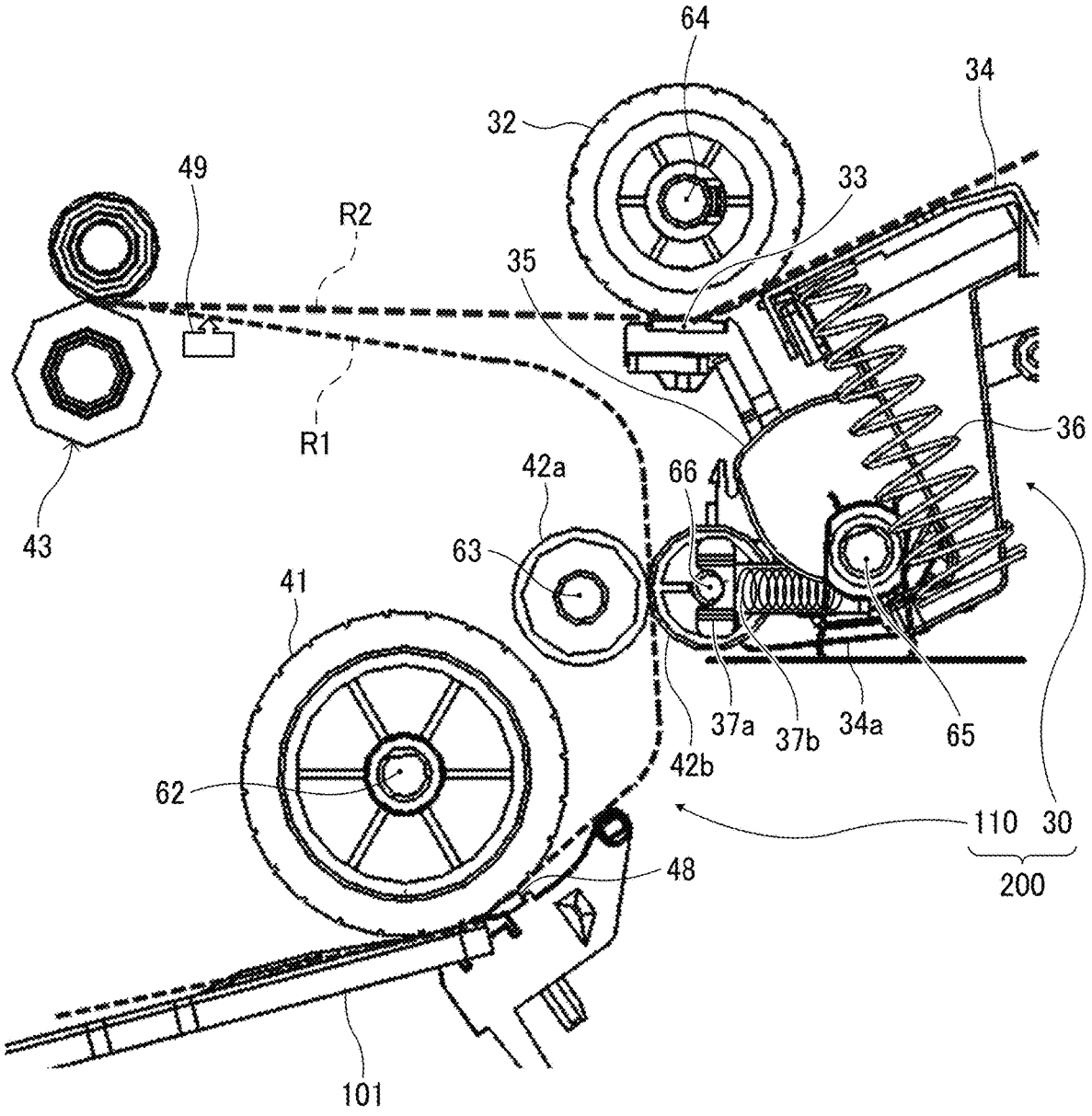
FIG. 5 is a diagram for explaining a sheet conveyance passage in the regular sheet feeder and a sheet conveyance passage in the bypass sheet feeder.
Figure 6:
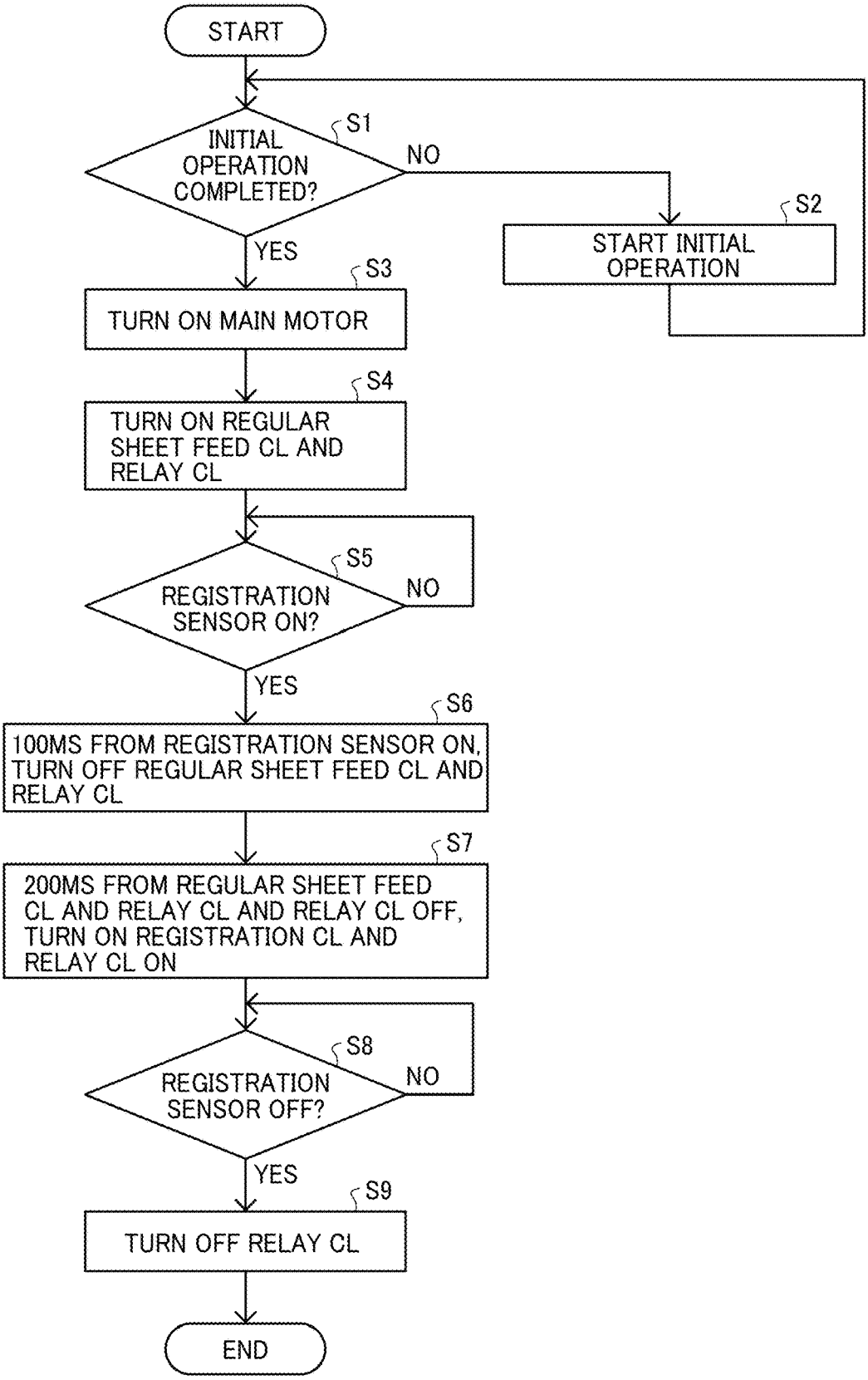
FIG. 6 is a flowchart of a control operation of sheet conveyance from the regular sheet feeder.

FIG. 5 is a diagram for explaining a sheet conveyance passage in the regular sheet feeder 110 and a sheet conveyance passage in the bypass sheet feeder 30. FIG. 6 is a flowchart of a control operation of sheet conveyance from the regular sheet feeder 110.

First, a description is given of conveyance of the recording sheet S from the regular sheet feeder 110, with reference to the flowchart of FIG. 6.

The regular sheet feeder 110 includes a regular sheet feeder bottom plate 101 that is biased upward toward the sheet feed roller 41. Since the regular sheet feeder bottom plate 101 is biased as described above, the sheet feed roller 41 is in contact with an uppermost recording sheet S of the plurality of recording sheets S loaded in a form of a sheet bundle on the regular sheet feeder bottom plate 101. When starting conveyance of the recording sheet S from the regular sheet feeder 110, the controller 51 confirms whether the initial operation is completed (step S1). When the initial operation is not completed (NO in step S1), the controller 51 starts the initial operation (step S2).

When the initial operation is completed (YES in step S1), the controller 51 turns on the main motor 61 (step S3), and then turns on the regular sheet feed clutch 62*a* and the relay clutch 63*a* (step S4). Consequently, as the sheet feed roller 41 rotates, the uppermost recording sheet S in the sheet tray 100 is fed toward the sheet separation pad 48. At this time, even if the second and subsequent recording sheets S are fed together with the uppermost recording sheet S, frictional force generated by friction with the sheet separation pad 48 prevents from further conveyance of the second and subsequent recording sheets S, and therefore the uppermost recording sheet S alone passes the sheet separation pad 48. Note that, while the recording sheet S is fed (conveyed) from the regular sheet feeder 110, no recording sheet S is conveyed from the bypass sheet feeder 30. Therefore, the bypass sheet feed clutch 64*a* and the bypass sheet bottom plate cam clutch 65*a* are remained in an OFF state.

Thereafter, the recording sheet S that is fed from the sheet tray 100 is conveyed along the regular sheet conveyance passage R1 in FIG. 5. At this time, a relay drive roller 42*a* that is one of the pair of relay rollers 42 is driven to rotate by the driving force of the main motor 61. Further, a relay driven roller 42*b* that is the other of the pair of relay rollers 42 has a roller shaft 66 that is received by a bearing 37*a*. As illustrated in FIG. 5, the relay driven roller 42*b* is biased by a biasing force of a pressure spring 37*b* at the bearing 37*a*, so that the relay driven roller 42*b* is in contact with the relay drive roller 42*a* due to the biasing force of the pressure spring 37*b*. Accordingly, the relay driven roller 42*b* is rotated along with rotation of the relay drive roller 42*a*. The recording sheet S conveyed through the regular sheet conveyance passage R1 is conveyed in a state in which the recording sheet S is sandwiched (held) in a relay nip region by the relay drive roller 42*a* and the relay driven roller 42*b*.

When the leading end of the recording sheet S reaches the registration sensor 49, the controller 51 determines whether the registration sensor 49 has turned on (step S5). When the registration sensor 49 has turned on (YES in step S5), the controller 51 turns off the regular sheet feed clutch 62*a* and the relay clutch 63*a* after a given time has elapsed (before the leading end of the recording sheet S reaches the pair of registration rollers 43) (step S6). The given time is, for example, 100 ms from the turning on of the registration sensor 49. After step S6, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the relay clutch 63*a* and the registration clutch at a timing at which the recording sheet S is overlaid on the toner image formed on the surface of the photoconductor 1 in the transfer nip region (step S7). The timing is, for example, 200 ms after the controller 51 has turned off the regular sheet feed clutch 62*a* and the relay clutch 63*a*. Accordingly, the controller 51 starts the pair of registration rollers 43 and the pair of relay rollers 42 to rotate to convey the recording sheet S toward the transfer nip region. At this time, since the regular sheet feed clutch 62*a* remains off, the sheet feed roller 41 is not rotated. Even in a state in which the trailing end of the recording sheet S is sandwiched (held) between the sheet feed roller 41 and the sheet separation pad 48, the sheet feed roller 41 is rotated along with movement of the recording sheet S conveyed by the conveyance force of the pair of registration rollers 43 and the conveyance force of the pair of relay rollers 42. Therefore, conveyance of the recording sheet S is not hindered. Then, the controller 51 determines whether the registration sensor 49 is turned off (step S8). When the trailing end of the recording sheet S reaches the registration sensor 49 and the registration sensor 49 is turned off (YES in step S8), the controller 51 turns off the relay clutch 63*a* (step S9) to stop rotation of the pair of relay rollers 42.

Figure 7:
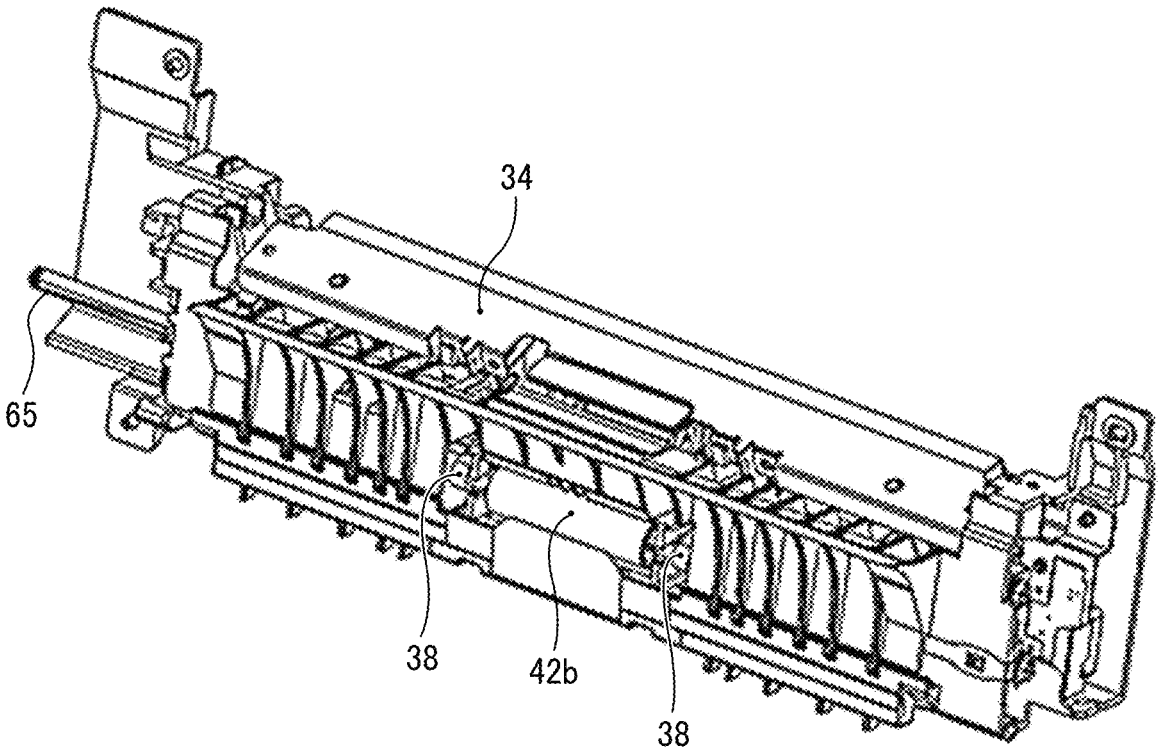
FIG. 7 is an external perspective view illustrating a state in which the bypass sheet tray is removed from the bypass sheet feeder.
Figure 8:
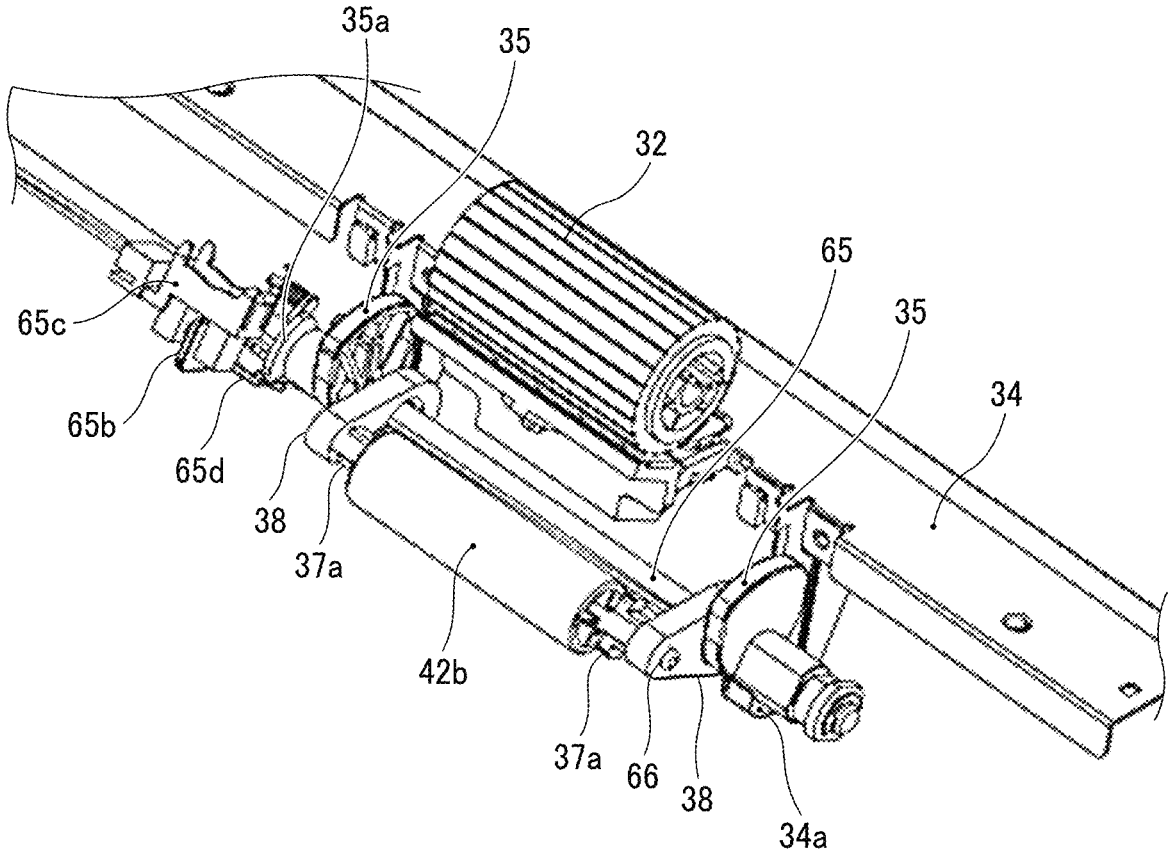
FIG. 8 is a perspective view illustrating a main part of the bypass sheet feeder.
Figure 9:
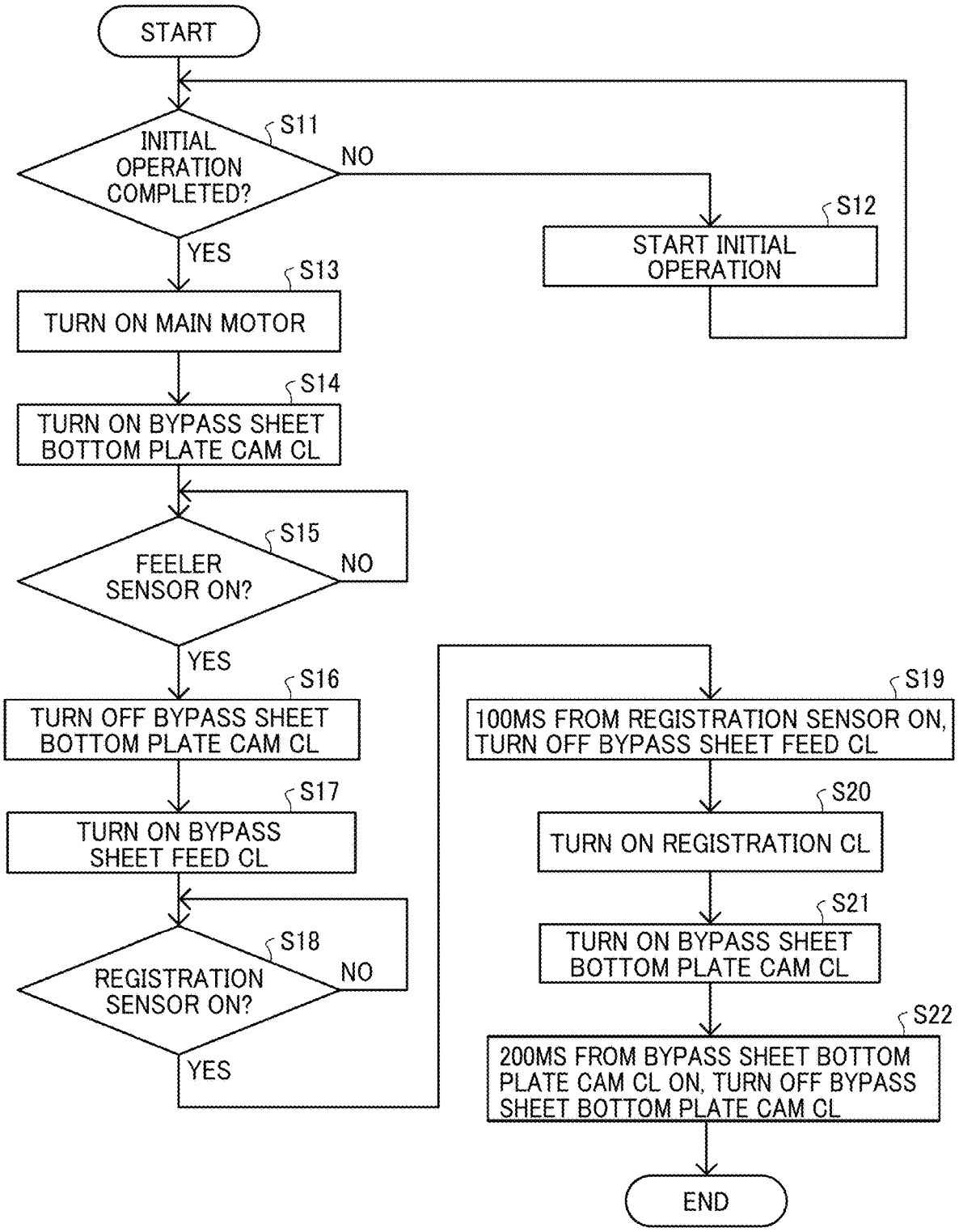
FIG. 9 is a flowchart of a control operation of sheet conveyance from the bypass sheet feeder.

Next, a description is given of conveyance of the recording sheet S from the bypass sheet feeder 30, with reference to FIGS. 7 to 9.

FIG. 7 is an external perspective view illustrating a state in which the bypass sheet tray 31 is removed from the bypass sheet feeder 30.

FIG. 8 is a perspective view illustrating the main configuration of the bypass sheet feeder 30.

FIG. 9 is a flowchart of a control operation of sheet conveyance from the bypass sheet feeder 30.

Figure 10:
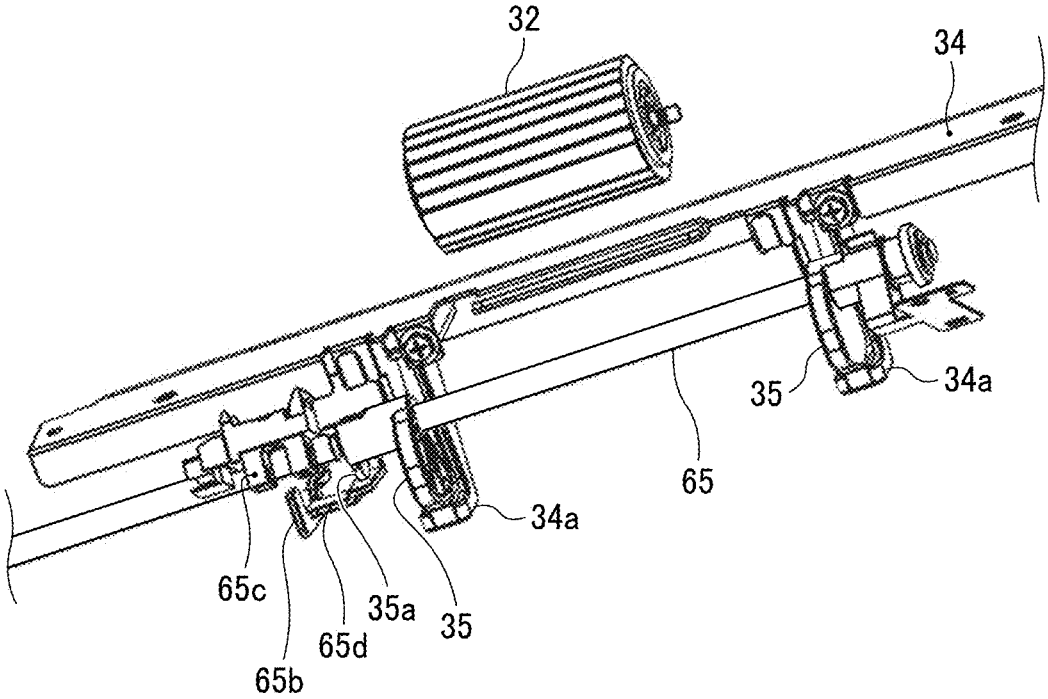
FIG. 10 is a perspective view illustrating a state in which a bypass bottom plate is separated from the bypass sheet feed roller.

The bypass bottom plate 34 is biased by a bottom plate spring 36 toward the bypass sheet feed roller 32 that is disposed facing the bypass bottom plate 34. Further, as illustrated in FIG. 8, a bottom plate guide 34*a* is provided on the bypass bottom plate 34, at a portion facing the bypass bottom plate cam 35. As the bypass bottom plate cam shaft 65 rotates, the bypass bottom plate cam 35 contacts the bottom plate guide 34*a* to press down the bottom plate guide 34*a* (see FIG. 10). By so doing, the bypass bottom plate 34 lowers against the biasing force of the bottom plate spring 36 to separate from the bypass sheet feed roller 32.

When starting conveyance of the recording sheet S from the bypass sheet feeder 30, the controller 51 confirms whether the initial operation is completed (step S11). When the initial operation is not completed (NO in step S11), the controller 51 starts the initial operation (step S12). When the initial operation is completed (YES in step S11), the controller 51 turns on the main motor 61 (step S13), and then turns on the bypass sheet bottom plate cam clutch 65*a* (step S14). As the bypass bottom plate cam shaft 65 rotates, the bypass bottom plate cam 35 changes states from a state in which the bypass bottom plate cam 35 is in contact with the bottom plate guide 34*a* (in other words, a state in which the bypass bottom plate 34 is separated from the bypass sheet feed roller 32) (see FIG. 10) to a state in which the bypass bottom plate cam 35 is not in contact with the bottom plate guide 34*a* (see FIGS. 5 and 8).

To be more specific, the bypass sheet feeder 30 includes a projecting plate 35*a* that is integrally formed with the bypass bottom plate cam 35 and a press-down lever 65*d* that presses down a cam detection feeler 65*b*. As the bypass bottom plate cam shaft 65 rotates, the projecting plate 35*a* rotates from a position at which the projecting plate 35*a* contacts the press-down lever 65*d* to press down the cam detection feeler 65*b* (see FIG. 10) to a position at which the projecting plate 35*a* is separated from the press-down lever 65*d*. Accordingly, the cam detection feeler 65*b* is lifted due to a given biasing force to be detected by a feeler sensor 65*c*. The controller 51 determines whether the feeler sensor 65*c* is turned on (step S15). When the feeler sensor 65*c* is turned on (YES in S15), the controller 51 turns off the bypass sheet bottom plate cam clutch 65*a* (step S16). Accordingly, the bypass bottom plate cam shaft 65 stops rotating in the state in which the bypass bottom plate cam 35 is separated from the bottom plate guide 34*a*. Therefore, the bypass bottom plate 34 is biased by the biasing force of the bottom plate spring 36 toward the bypass sheet feed roller 32. As a result, the bypass sheet feed roller 32 is in contact with the uppermost recording sheet S of the plurality of recording sheets S loaded in a form of a sheet bundle on the bypass sheet tray 31 and the bypass bottom plate 34. The bypass sheet tray 31 and the bypass bottom plate 34 are coupled to each other, each of which functioning as a sheet loader.

Subsequently, the controller 51 turns on the bypass sheet feed clutch 64*a* (step S17). Consequently, as the bypass sheet feed roller 32 rotates, the uppermost recording sheet S on the bypass bottom plate 34 is fed toward the sheet separation pad 33. At this time, even if the second and subsequent recording sheets S are fed together with the uppermost recording sheet S, the conveyance of the second and subsequent recording sheets S is hindered by the frictional force with the sheet separation pad 33, and the uppermost recording sheet S alone passes the sheet separation pad 33.

Note that, while the recording sheet S is fed (conveyed) from the bypass sheet feeder 30, no recording sheet S is conveyed from the regular sheet feeder 110. Therefore, the regular sheet feed clutch 62*a* and the relay clutch 63*a* are remained in an OFF state.

Thereafter, the recording sheet S that is fed from the bypass sheet tray 31 is conveyed along the bypass sheet conveyance passage R2 in FIG. 5. When the leading end of the recording sheet S reaches the registration sensor 49, the controller 51 determines whether the registration sensor 49 has turned on (step S18). When the registration sensor 49 has turned on (YES in step S18), the controller 51 turns off the bypass sheet feed clutch 64*a* after a given time has elapsed (before the leading end of the recording sheet S reaches the pair of registration rollers 43) (step S19). The given time is, for example, 100 ms from the turning on of the registration sensor 49. After step S19, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the registration clutch at a timing at which the recording sheet S is overlaid on the toner image formed on the surface of the photoconductor 1 in the transfer nip region (step S20). Accordingly, the controller 51 starts the pair of registration rollers 43 to rotate to convey the recording sheet S toward the transfer nip region. At this time, the bypass sheet feed clutch 64*a* remains in the OFF state, and therefore the bypass sheet feed roller 32 does not rotate. In a state in which the trailing end of the recording sheet S is still sandwiched (held) between the sheet feed roller 32 and each of the sheet separation pad 33 and the bypass bottom plate 34, the sheet conveyance load is significantly great (heavy). Therefore, it is likely that the recording sheet S is not conveyed properly by the sheet conveyance force of the pair of registration rollers 43 alone.

In order to address this inconvenience, the controller 51 turns on the bypass sheet bottom plate cam clutch 65*a* (step S21) to rotate the bypass bottom plate cam shaft 65. Along with the rotation of the bypass bottom plate cam shaft 65, the bypass bottom plate cam 35 changes states from the state in which the bypass bottom plate cam 35 is not in contact with the bottom plate guide 34*a* (in other words, a state in which the bypass bottom plate 34 is biased to the bypass sheet feed roller 32) to the state in which the bypass bottom plate cam 35 is in contact with the bottom plate guide 34*a* (in other words, the state in which the bypass bottom plate 34 is separated from the bypass sheet feed roller 32). To be more specific, the controller 51 turns on the bypass sheet bottom plate cam clutch 65*a* and, after a given time (for example, after 200 ms), turns off the bypass sheet bottom plate cam clutch 65*a* (step S22). Accordingly, the bypass bottom plate cam shaft 65 stops rotating in the state in which the bypass bottom plate cam 35 is in contact with the bottom plate guide 34*a*. Therefore, the bypass bottom plate 34 is separated from the bypass sheet feed roller 32. As a result, the trailing end of the recording sheet S is not sandwiched (held) between the bypass sheet feed roller 32 and the bypass bottom plate 34, and therefore the sheet conveyance load is reduced. Accordingly, the recording sheet S is conveyed properly by the sheet conveyance force of the pair of registration rollers 43 alone.

As illustrated in FIG. 7, the bypass sheet feeder 30 in the present embodiment has a unit structure in which the relay driven roller 42*b*, which is one of the pair of relay rollers 42, is supported integrally with the bypass sheet feeding mechanism. This unit structure including the relay driven roller 42*b* and the bypass sheet feeding mechanism is screwed and fixed to the housing 50 of the image forming apparatus 1000.

Here, when a device error (problem) to suspend conveyance of the recording sheet S, such as a paper jam error, occurs to the image forming apparatus 1000, the recording sheet S remaining in the image forming apparatus 1000 needs to be removed. In order to facilitate the work of removing the recording sheet S, a user opens the possible areas in which the recording sheet S is sandwiched (such as the sheet conveyance nip region of the pair of relay rollers 42 and the nip region of the bypass sheet feed roller 32 and the bypass bottom plate 34) and removes the sheet tray 100 from the image forming apparatus 1000 in a sheet conveyance direction or in a direction intersecting the sheet conveyance direction, so that the recording sheet S remaining in the image forming apparatus 1000 is removed downward easily. Therefore, in the image forming apparatus 1000 of the present embodiment, when a failure such as a paper jam has occurred to the image forming apparatus 1000 while the recording sheet S is being fed from the sheet tray 100 in the image forming apparatus 1000, the rollers (i.e., the relay drive roller 42*a* and the relay driven roller 42*b*) of the pair of relay rollers 42 are separated from each other to remove the recording sheet S.

As a configuration in which the rollers of the pair of relay rollers 42 can be separated from each other, known image forming apparatuses employ a configuration in which the relay driven roller 42*b* is supported on the door openably and closably attached to the housing 50 of the image forming apparatus 1000. However, in this configuration, the door to separate the pair of relay rollers 42 is needed, as well as a user operation to open the door and close the door after removing the recording sheet S. Then, normally when a failure such as a paper jam has occurred to the image forming apparatus 1000, in addition to this user operation to open and close the door, another user operation is also needed to open the transfer nip region. Therefore, in the configuration in which the user operation to open and close the door for separating the rollers of the pair of relay rollers 42 and removing the recording sheet S remaining in the image forming apparatus 1000, more user operations are forced to be performed, which degrades convenience of the user when removing the recording sheet S.

For example, a known sheet conveying device includes three sheet trays having respective sheet conveyance passages. The known sheet conveying device can convey a sheet in each of the three sheet trays via the sheet conveyance passage of the selected sheet tray, to a transfer drum. The known sheet conveying device further includes a pair of intermediate conveyance rollers (a pair of sheet conveying rollers) on the sheet conveyance passage corresponding to a selected one of the three sheet trays. The pair of intermediate conveyance rollers grips a sheet fed from the selected one of the three sheet trays. In the known sheet conveying device, each sheet fed out from the other two sheet trays is not gripped by the pair of intermediate conveyance rollers. The pair of intermediate conveyance rollers has two rollers. One roller of the pair of intermediate conveyance rollers is supported on a door. At occurrence of a paper jam, opening the door separates the one roller from the other roller of the pair of intermediate conveyance rollers, so that a user can remove the jammed sheet easily.

However, the known sheet conveying device does not perform convenient operations with the configuration in which the one roller of the pair of intermediate conveyance rollers is separated from the other roller of the pair of intermediate conveyance rollers.

In order to address the degradation of user convenience, when a failure such as a paper jam occurs in the image forming apparatus 1000, a moving unit to move a movable member such as the bypass bottom plate 34 that moves when the recording sheet S is conveyed in the bypass sheet feeder 30, so as to separate the rollers of the pair of relay rollers 42 along with movement of the movable member.

In the present embodiment, the rollers of the pair of relay rollers 42 are separated in the regular sheet conveyance passage R1 along with movement of a movable member that is used for conveying the recording sheet S in the bypass sheet conveyance passage R2. In the present embodiment, when the recording sheet S is conveyed using the regular sheet conveyance passage R1, the recording sheet S is not conveyed in the bypass sheet conveyance passage R2 simultaneously. Therefore, in a case in which a failure such as a paper jam occurs while the recording sheet S is conveyed in the regular sheet conveyance passage R1, when the rollers of the pair of relay rollers 42 are separated from each other, movement of the movable member used to conveying the recording sheet S in the bypass sheet conveyance passage R2 does not hinder conveyance of the recording sheet S or removal of the recording sheet S remaining in the image forming apparatus 1000.

In the present embodiment, a sheet feeder for bypass sheet feeding such as the bypass sheet feeder 30 causes the recording sheet S on the bypass bottom plate 34 to contact the bypass sheet feed roller 32, thereby feeding the recording sheet S. Therefore, in the present embodiment, the bypass bottom plate 34 functions as a movable member. Along with movement of the bypass bottom plate 34, the rollers of the pair of relay rollers 42 are separated from each other.

Specifically, the moving unit that causes the bypass bottom plate 34 to move rotates the bypass bottom plate cam shaft 65 by the driving force of the main motor 61, as described above. Then, when the bypass bottom plate cam shaft 65 is located at a rotational position at which the bypass bottom plate cam 35 presses down the bottom plate guide 34*a* against the biasing force of the bottom plate spring 36, the bypass bottom plate 34 is lowered (moved downward) to separate from the bypass sheet feed roller 32. On the other hand, when the bypass bottom plate cam shaft 65 is located at the rotational position at which the bypass bottom plate cam 35 separates from the bottom plate guide 34*a*, the bypass bottom plate 34 is lifted (moved upward) by the biasing force of the bottom plate spring 36 to contact the bypass sheet feed roller 32. As a slide lever 38 that functions as a roller support supporting the relay driven roller 42*b*, which is one roller of the pair of relay rollers 42, to move along with rotation of the bypass bottom plate cam shaft 65, the separation unit of the present embodiment separates or contacts the rollers of the pair of relay rollers 42. A detailed description of the separation unit is given below.

Figure 11:
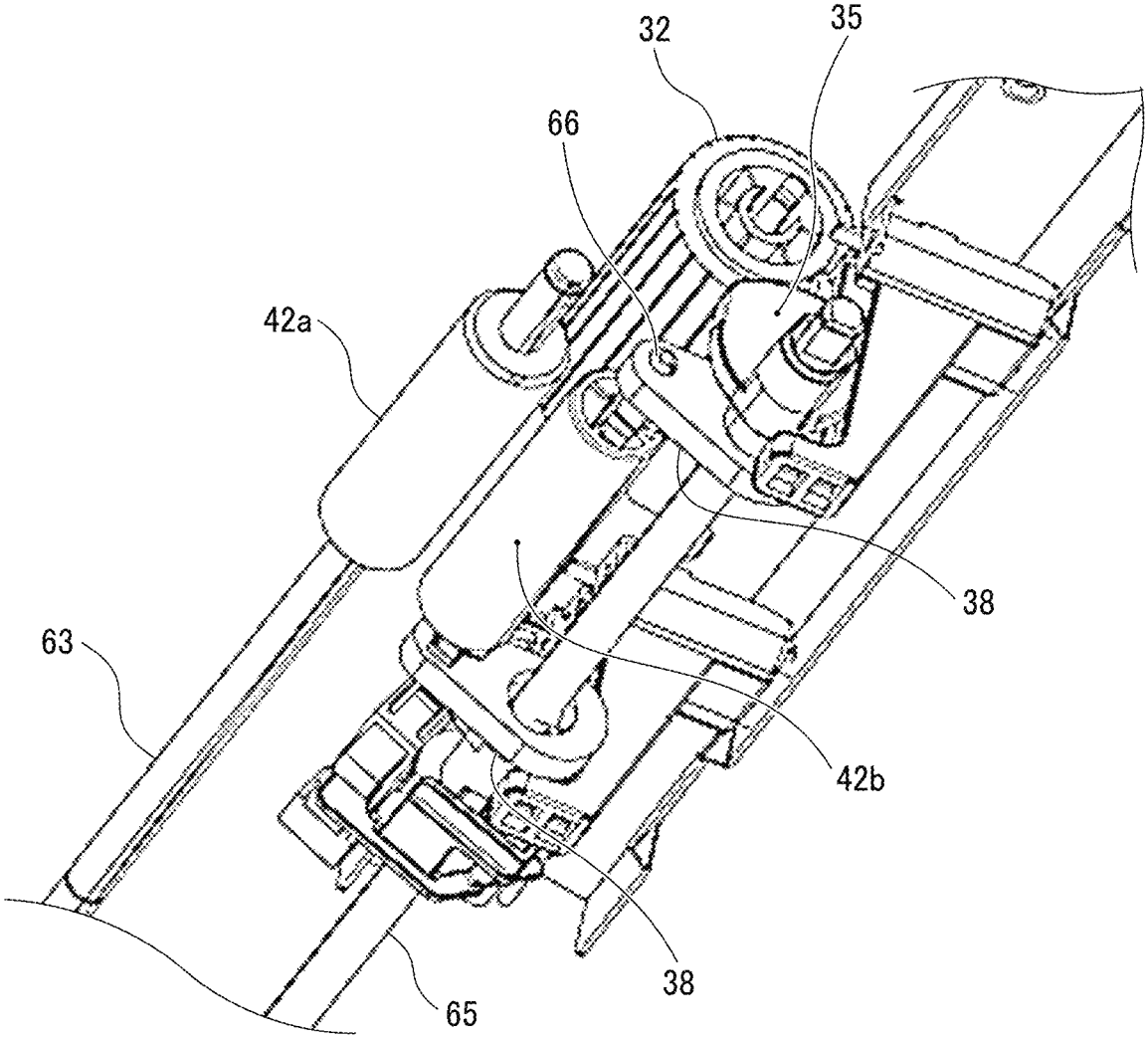
FIG. 11 is a perspective view illustrating a configuration of a separation unit that separates the two rollers of a pair of relay rollers from each other.

FIG. 11 is a perspective view illustrating a configuration of the separation unit that separates the rollers of the pair of relay rollers 42 from each other.

Figure 12:
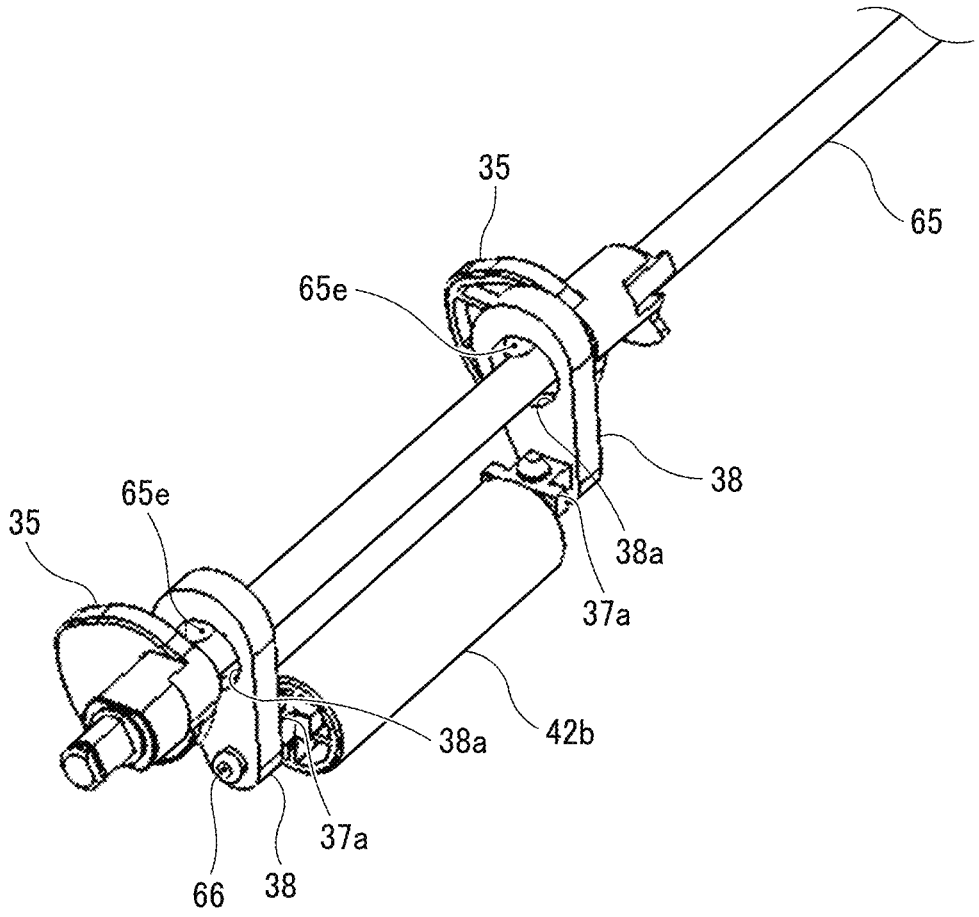
FIG. 12 is a perspective view illustrating the main configuration of the separation unit.

FIG. 12 is a perspective view illustrating the main configuration of the separation unit.

Figure 13:
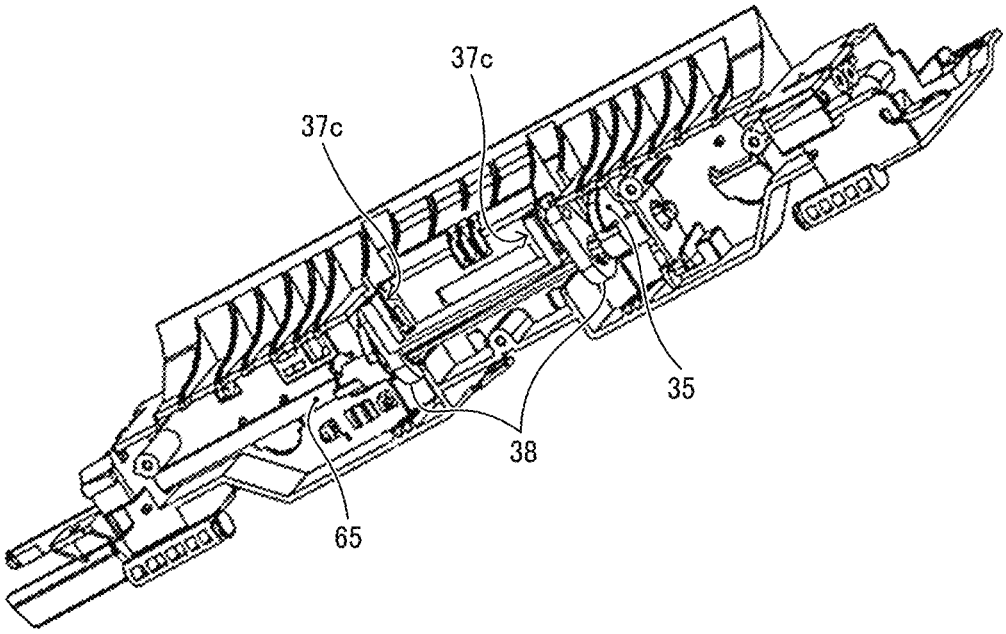
FIG. 13 is a perspective view illustrating a support frame of the bypass sheet feeder to which a relay driven roller of the pair of relay rollers is attached.

FIG. 13 is a perspective view illustrating a support frame of the bypass sheet feeder 30 to which the relay driven roller 42*b* of the pair of relay rollers 42 is attached. Note that FIG. 13 illustrates the support frame without the relay driven roller 42*b*, for convenience.

Figure 14A:
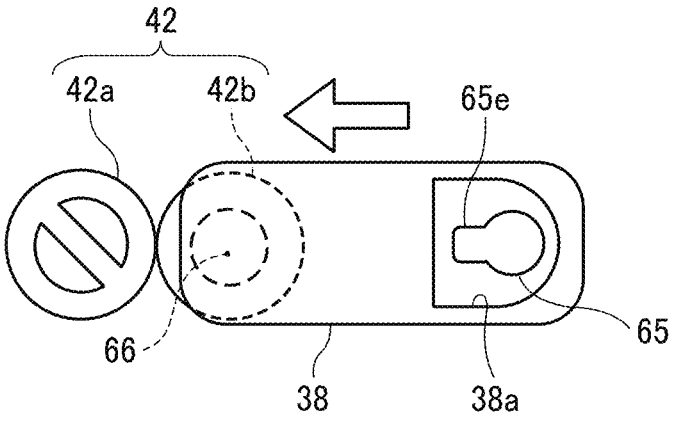
FIG. 14A is a diagram for explaining a state in which the two rollers of the pair of relay rollers come to contact with each other.
Figure 14B:
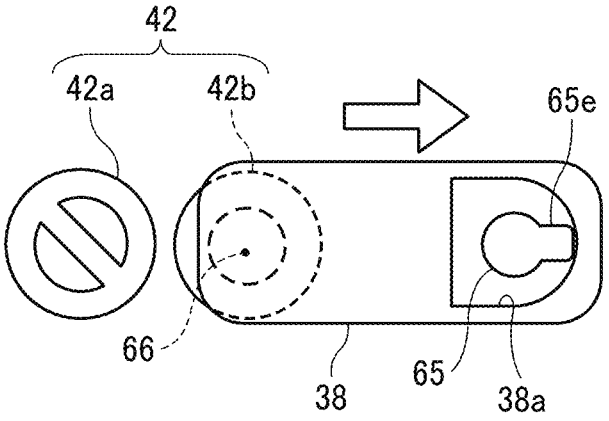
FIG. 14B is a diagram for explaining a state in which the two rollers of the pair of relay rollers separate from each other.

FIG. 14A is a diagram for explaining a state in which the rollers of the pair of relay rollers 42 come to contact with each other. FIG. 14B is a diagram for explaining a state in which the rollers of the pair of relay rollers 42 separate from each other.

As illustrated in FIG. 13, the bearing 37*a* that receives the roller shaft 66 of the pair of relay rollers 42 is attached to a slide slot 37*c* formed in the support frame of the bypass sheet feeder 30, so that the relay driven roller 42*b* is supported to be slidable in a direction in which the relay driven roller 42*b* separates from the relay drive roller 42*a*. The roller shaft 66 of the pair of relay rollers 42 is supported by the slide lever 38 on the outside of each bearing 37*a* in the axial direction. In other words, the roller shaft 66 of the relay driven roller 42*b* of the pair of relay rollers 42 is supported by the slide lever 38 in the axial direction. As described above, the bearing 37*a* of the relay driven roller 42*b* is biased by the pressure spring 37*b* in a direction in which the relay driven roller 42*b* contacts the relay drive roller 42*a* (that is, a direction indicated by arrow in FIG. 14A). Therefore, the slide lever 38 supporting the roller shaft 66 of the rollers of the pair of relay rollers 42 receives the biasing force in the same direction as the bearing 37*a*.

The slide lever 38 has a slide hole 38*a* that functions as an opening through which the bypass bottom plate cam shaft 65 is inserted, at an end opposite the end supporting the roller shaft 66 of the pair of relay rollers 42. On the other hand, as illustrated in FIG. 12, the bypass bottom plate cam shaft 65 has a pressing portion 65*e* configured to face the slide hole 38*a* of the slide lever 38, so that the pressing portion 65*e* of the bypass bottom plate cam shaft 65 presses against an inner wall (that functions as a pressing target portion) of the slide hole 38*a* of the slide lever 38. The pressing portion 65*e* rotates along with rotation of the bypass bottom plate cam shaft 65.

When the rotational position of the bypass bottom plate cam shaft 65 is located at a position to lower the bypass bottom plate 34 (that is, a position at which the bypass bottom plate 34 separates from the bypass sheet feed roller 32), the pressing portion 65*e* on the bypass bottom plate cam shaft 65 is located at a non-pressing position, as illustrated in FIG. 14A. At this time, the slide lever 38 is movable in a direction in which the relay driven roller 42*b* contacts the relay drive roller 42*a* (that is, the direction indicated by arrow in FIG. 14A) due to a gap between the slide hole 38*a* of the slide lever 38 and the bypass bottom plate cam shaft 65. Therefore, the relay driven roller 42*b* contacts the relay drive roller 42*a* due to the biasing force of the pressure spring 37*b*, thereby conveying the recording sheet S in the image forming apparatus 1000. Note that, since the bypass bottom plate 34 is separated from the bypass sheet feed roller 32, the recording sheet P is not conveyed from the bypass sheet feeder 30, conveyance of the recording sheet S in the image forming apparatus 1000 does not hinder conveyance of the recording sheet S from the bypass sheet feeder 30.

By contrast, when the rotational position of the bypass bottom plate cam shaft 65 is located at a position to lift the bypass bottom plate 34 (that is, a position at which the bypass bottom plate 34 contacts the bypass sheet feed roller 32), the pressing portion 65*e* on the bypass bottom plate cam shaft 65 is located at a pressing position, as illustrated in FIG. 14B. At this time, while the slide lever 38 is biased by the biasing force of the pressure spring 37*b*, the pressing portion 65*e* presses the inner wall of the slide hole 38*a* against the biasing force of the pressure spring 37*b*, so that the slide lever 38 is moved in a direction in which the relay driven roller 42*b* separates from the relay drive roller 42*a* (that is, the direction indicated by arrow in FIG. 14B). As a result, the relay driven roller 42*b* is separated from the relay drive roller 42*a*, thereby facilitating removal of the recording sheet S remaining in the image forming apparatus 1000 when conveying the recording sheet S in the image forming apparatus 1000. Note that, although the bypass bottom plate 34 is in contact with the bypass sheet feed roller 32, any jammed recording sheet S is not conveyed in the bypass sheet conveyance passage when the failure such as a paper jam occurs in the image forming apparatus 1000. Therefore, contact of the bypass bottom plate 34 with the bypass sheet feed roller 32 does not hinder removal of the recording sheet S remaining in the image forming apparatus 1000 due to the paper jam occurred while the recording sheet S is conveyed in the image forming apparatus 1000.

According to the present embodiment, the rollers of the pair of relay rollers 42 are separated in the regular sheet conveyance passage R1 along with movement of the bypass bottom plate 34 that functions as a movable member used for conveying the recording sheet S in the bypass sheet conveyance passage R2. Accordingly, a simple configuration that does not include a dedicated moving unit that separates the rollers of the pair of relay rollers 42 from each other achieves a highly convenient structure without a user operation to separate the rollers of the pair of relay rollers 42.

Next, a description is given of a process flow of operations for an irregular stop in the image forming apparatus 1000.

Figure 15:
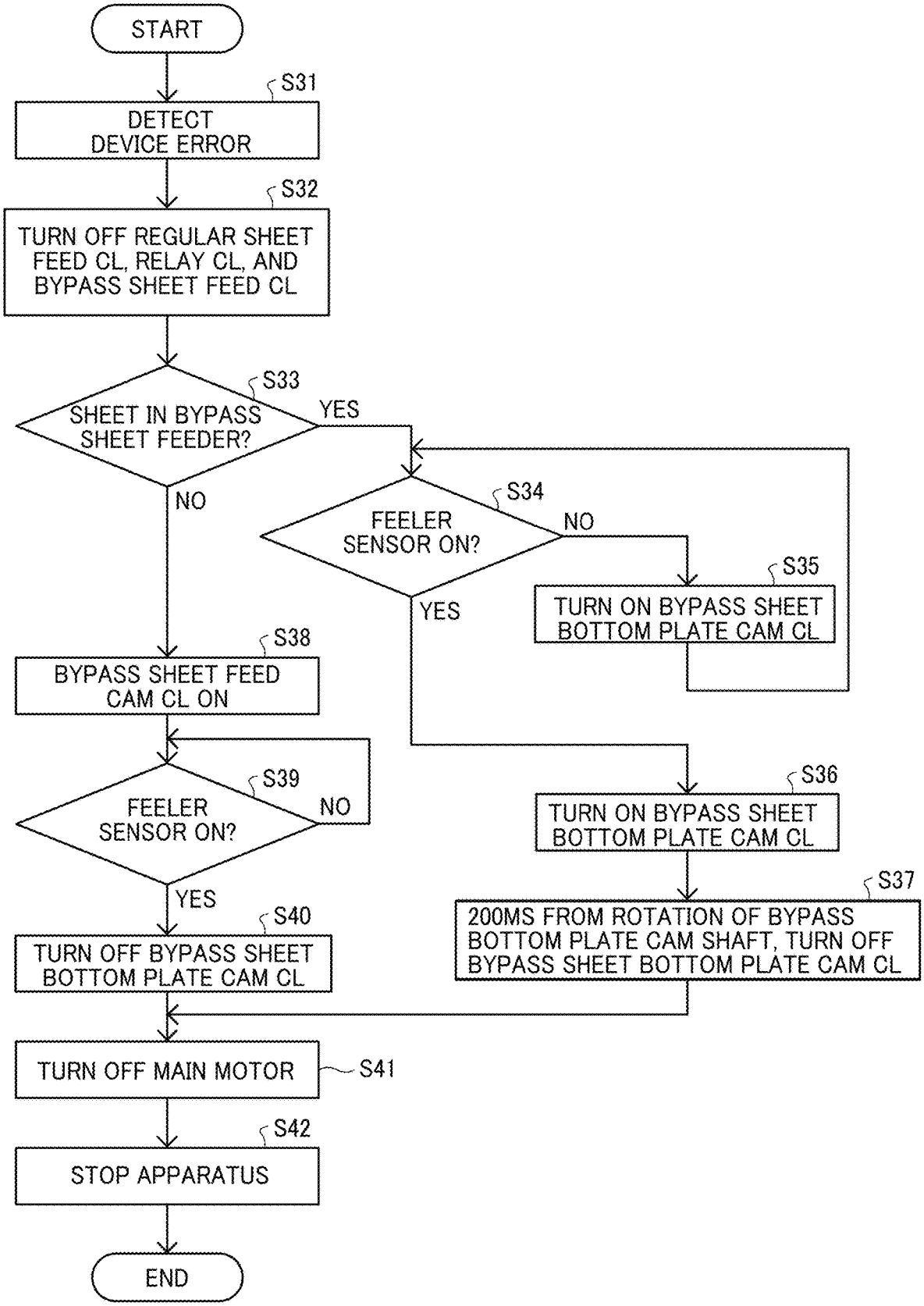
FIG. 15 is a flowchart of a process flow of operations for an irregular stop of the image forming apparatus according to an embodiment of this disclosure.

FIG. 15 is a flowchart of a process flow of operations for an irregular stop of the image forming apparatus 1000 according to an embodiment of this disclosure.

In the image forming apparatus 1000, when a device error (problem) to suspend conveyance of the recording sheet S, such as a device malfunction including a paper jam, is detected (step S31), the controller 51 first turns off the regular sheet feed clutch 62*a*, the relay clutch 63*a*, and the bypass sheet feed clutch 64*a* to perform irregular stop (step S32). Then, the controller 51 determines, from control data, whether the recording sheet S is being conveyed by the bypass sheet feeder 30 (step S33).

When the recording sheet S is being conveyed by the bypass sheet feeder 30 (YES in step S33), it is likely in the present embodiment that the recording sheet S is being sandwiched (held) between the bypass sheet feed roller 32 and the bypass bottom plate 34. Therefore, the bypass sheet feed roller 32 and the bypass bottom plate 34 are separated from each other. In the present embodiment, when the bypass bottom plate cam shaft 65 rotates by 200 ms in the state in which the bypass bottom plate 34 is lifted and the feeler sensor 65*c* is turned on, the state changes to the state in which the bypass bottom plate 34 is lowered to separate from the bypass sheet feed roller 32. Note that, at this time, the rollers of the pair of relay rollers 42 are in contact with each other.

In the present embodiment, as described above, while the recording sheet S is being conveyed by the bypass sheet feeder 30, the bypass bottom plate 34 may be in contact with the bypass sheet feed roller 32 or be separated from the bypass sheet feed roller 32. Therefore, the controller 51 determines whether the feeler sensor 65*c* is turned on (step S34). When the feeler sensor 65*c* is turned on (YES in step S34), the controller 51 turns on the bypass sheet bottom plate cam clutch 65*a* (step S36) to rotate the bypass bottom plate cam shaft 65. Then, after 200 ms has elapsed, the controller 51 turns off the bypass sheet bottom plate cam clutch 65*a* (step S37) to stop rotation of the bypass bottom plate cam shaft 65. Thereafter, the controller 51 turns off the main motor 61 (step S41), and then stops the image forming apparatus 1000 (step S42), so that a user can remove the jammed recording sheet(s) S from in the image forming apparatus 1000.

On the other hand, when the feeler sensor 65*c* is turned off (NO in step S34), the controller 51 turns off the bypass sheet bottom plate cam clutch 65*a* (step S35) to rotate the bypass bottom plate cam shaft 65. Then, the procedure returns to step S34. When the feeler sensor 65*c* is turned on (YES in step S34), the controller 51 continues to turn on the bypass sheet bottom plate cam clutch 65*a* (step S36) to continuously rotate the bypass bottom plate cam shaft 65. Then, after 200 ms has elapsed, the controller 51 turns off the bypass sheet bottom plate cam clutch 65*a* (step S37) to stop rotation of the bypass bottom plate cam shaft 65. Thereafter, the controller 51 turns off the main motor 61 (step S41), and then stops the image forming apparatus 1000 (step S42), so that the user can remove the jammed recording sheet(s) S from in the image forming apparatus 1000.

With the above-described control, when a device error (problem) to suspend conveyance of the recording sheet S occurs when conveying the recording sheet S by the bypass sheet feeder 30, the bypass bottom plate 34 is separated from the bypass sheet feed roller 32. This control facilitates removal of the recording sheet S remaining in the bypass sheet conveyance passage R2 (in other words, the recording sheet S sandwiched between the bypass sheet feed roller 32 and the bypass bottom plate 34).

Further, when the recording sheet S is being conveyed by the regular sheet feeder 110 (not by the bypass sheet feeder 30) (NO in step S33), it is likely in the present embodiment that the recording sheet S is being sandwiched (held) between the rollers of the pair of relay rollers 42. Therefore, the rollers of the pair of relay rollers 42 are separated from each other. In the present embodiment, when the feeler sensor 65*c* is turned on (in an ON state), the bypass bottom plate 34 is lifted to contact the bypass sheet feed roller 32 and, at the same time, the rollers of the pair of relay rollers 42 are separated from each other.

In the present embodiment, as described above, the rollers of the pair of relay rollers 42 are constantly in contact with each other while the recording sheet S is being conveyed by the regular sheet feeder 110 in the image forming apparatus 1000. Therefore, the controller 51 turns on the bypass sheet bottom plate cam clutch 65*a* without determining whether the feeler sensor 65*c* is turned on (step S38) to rotate the bypass bottom plate cam shaft 65. Then, the controller 51 determines whether the feeler sensor 65*c* is turned on (step S39). When the feeler sensor 65*c* is turned on (YES in step S39), the controller 51 turns off the bypass sheet bottom plate cam clutch 65*a* (step S40) to stop rotation of the bypass bottom plate cam shaft 65. Thereafter, the controller 51 turns off the main motor 61 (step S41), and then stops the image forming apparatus 1000 (step S42), so that the user can remove the jammed recording sheet(s) S from in the image forming apparatus 1000.

With the above-described control, when the device error (problem) to suspend conveyance of the recording sheet S occurs when conveying the recording sheet S by the regular sheet feeder 110, the rollers of the pair of relay rollers 42 are separated from each other. This control facilitates removal of the recording sheet S remaining in the regular sheet conveyance passage R1 (in other words, the recording sheet S sandwiched between the rollers of the pair of relay rollers 42). Moreover, a user operation to continuously separate the rollers of the pair of relay rollers 42 from each other is avoided, which is highly convenient. In addition, the configuration of the present embodiment achieves separation of the rollers of the pair of relay rollers 42 along with movement of the bypass bottom plate 34 functioning as a movable member used for conveying the recording sheet S in the bypass sheet conveyance passage R2 without employing a dedicated moving unit to perform the above-described operation. Therefore, a simple configuration that does not include such a dedicated moving unit that separates the rollers of the pair of relay rollers 42 from each other achieves a highly convenient structure without a user operation to separate the rollers of the pair of relay rollers 42.

Next, a description is given of a process flow of operations for finishing the irregular stop in the image forming apparatus 1000.

Figure 16:
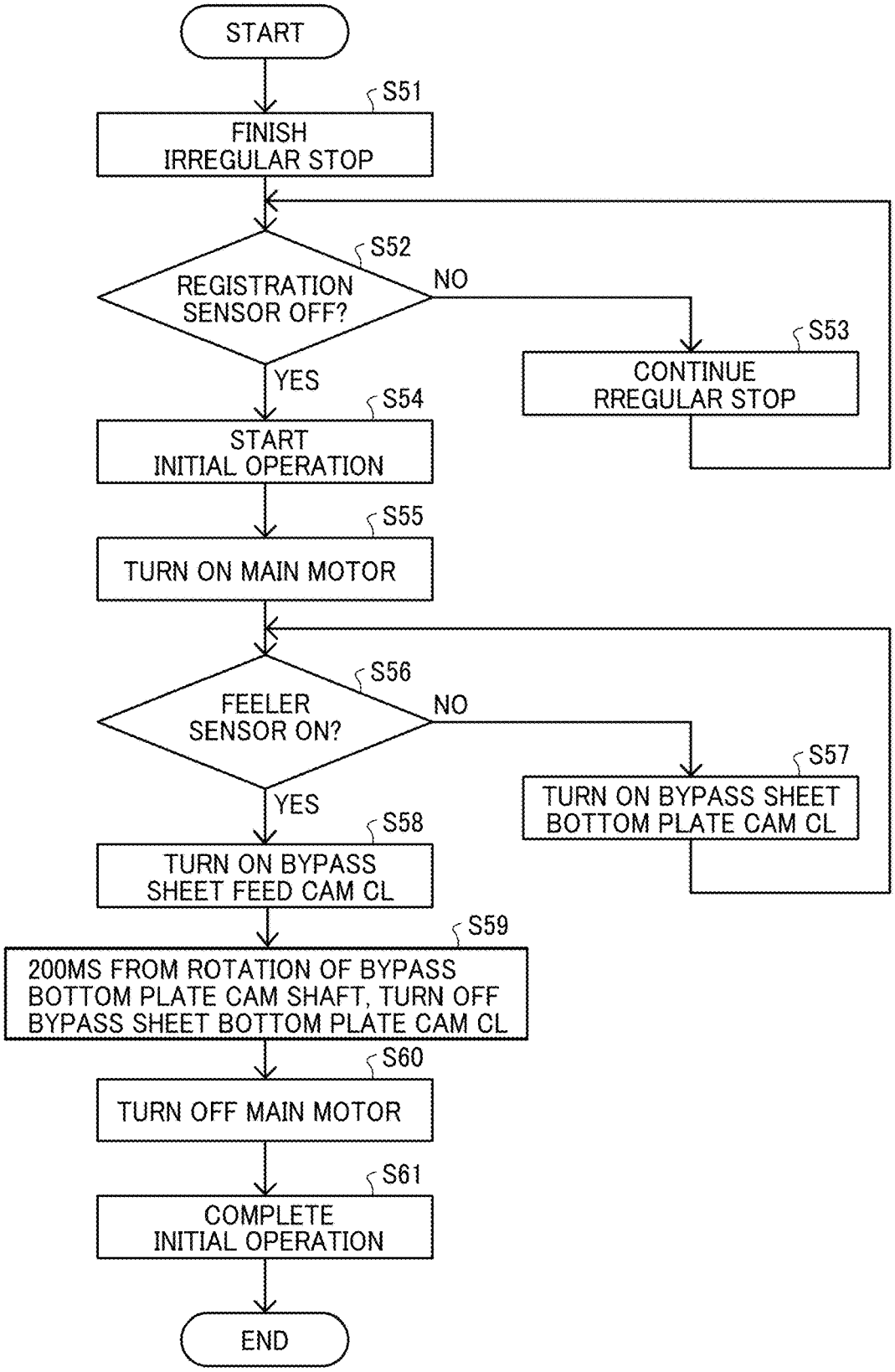
FIG. 16 is a flowchart of a process flow of operations for finishing the irregular stop of the image forming apparatus according to an embodiment of this disclosure.

FIG. 16 is a flowchart of a process flow of operations for finishing the irregular stop of the image forming apparatus 1000 according to an embodiment of this disclosure.

When an irregular stop of the image forming apparatus 1000 occurs and removal of the recording sheet S is completed, the controller 51 finishes (cancels) the irregular stop of the image forming apparatus 1000 (step S51), and firstly determines whether the registration sensor 49 is turned off (step S52). When a device error (problem) to suspend conveyance of the recording sheet S occurs to the image forming apparatus 1000, the recording sheet S that has been under sheet conveyance is located at an opposing position to face the registration sensor 49. Therefore, when the registration sensor 49 is turned off (YES in step S52), the controller 51 determines that the recording sheet S remaining in the image forming apparatus 1000 at the irregular stop is removed, and then starts an initial operation to resume the print job (step S54). On the other hand, when the registration sensor 49 is turned on (NO in step S52), the controller 51 causes the state of the image forming apparatus 1000 to return to (or continue) the irregular stop (step S53). Consequently, the controller 51 informs a user to encourage the user to remove the recording sheet S from the image forming apparatus 1000.

When the initial operation is started in step S54, the controller 51 first turns on the main motor 61 (step S55). Then, the controller 51 determines whether the feeler sensor 65*c* is turned on (step S56). When the feeler sensor 65*c* is turned on (YES in step S56), the controller 51 turns on the bypass sheet bottom plate cam clutch 65*a* (step S58) to rotate the bypass bottom plate cam shaft 65. Then, after 200 ms has elapsed, the controller 51 turns off the bypass sheet bottom plate cam clutch 65*a* (step S59) to stop rotation of the bypass bottom plate cam shaft 65. Then, the controller 51 turns off the main motor 61 (step S60) to complete the initial operation (step S61) to end the control flow in the flowchart of FIG. 16.

On the other hand, when the feeler sensor 65*c* is turned off (NO in step S56), the controller 51 turns on the bypass sheet bottom plate cam clutch 65*a* (step S57) to rotate the bypass bottom plate cam shaft 65. Then, the procedure returns to step S56. When the feeler sensor 65*c* is turned on (YES in step S56), the controller 51 continues to turn on the bypass sheet bottom plate cam clutch 65*a* (step S58) to continuously rotate the bypass bottom plate cam shaft 65. Then, after 200 ms has elapsed, the controller 51 turns off the bypass sheet bottom plate cam clutch 65*a* (step S59) to stop rotation of the bypass bottom plate cam shaft 65. Then, the controller 51 turns off the main motor 61 (step S60), so that the initial operation is completed (step S61) to end the control flow in the flowchart of FIG. 16.

As described above, in the configuration of the present embodiment, when removing the recording sheet S remaining in the regular sheet conveyance passage R1, the rollers of the pair of relay rollers 42 that is used for conveying the recording sheet S in the regular sheet conveyance passage R1 are separated along with movement of the bypass bottom plate 34 functioning as a movable member that is used for conveying the recording sheet S in the bypass sheet conveyance passage R2. However, a configuration of the sheet conveying device is not limited to this configuration. For example, in a case in which the bypass sheet feeder 30 employs a sheet feeder having a configuration in which the bypass sheet feed roller 32 is lowered (moved downward) to press (contact) the bypass sheet feed roller 32 to a recording sheet on the bypass sheet tray 31 to feed the recording sheet, the bypass sheet feed roller 32 may be a movable member to separate the rollers of the pair of relay rollers 42 along with movement of the bypass sheet feed roller 32. Further, for example, the rollers of the pair of relay rollers 42 may be separated from each other along with movement of a movable member that is used in a sheet conveyance passage other than the bypass sheet conveyance passage R2 (for example, the reverse sheet conveyance passage R5).

Further, in the present embodiment, a description of the separation unit to separate the rollers of the pair of relay rollers 42 used in the regular sheet conveyance passage R1 has been made but any other separation unit may be applied. For example, a separation unit to separate rollers of other pair of conveyance rollers (for example, the pair of sheet ejection rollers 46) may be employed. In addition, the pair of relay rollers 42 of the present embodiment in which the rollers are separated from each other is a pair of sheet conveying rollers including a drive roller and a driven roller. However, the configuration of the pair of sheet conveying rollers applied to the present embodiment is not limited to the above-described pair of relay rollers 42. For example, the pair of sheet conveying rollers may include two drive rollers or two driven rollers.

Further, in the present embodiment according to this disclosure, the image forming apparatus 1000 is described as an example of a printer. However, the image forming apparatus 1000 may be a copier including an image reading device or a copier having a function of a facsimile machine. Further, this disclosure is applicable to image forming apparatuses adapted to form images through other schemes, such as known ink jet schemes, known toner projection schemes, or the like as well as to image forming apparatuses adapted to form images through electrophotographic schemes. Further, as long as a sheet conveying device is provided, this disclosure is not limited to an image forming apparatus but is also applicable to an image reading device provided with an automatic document feeder (ADF).

The configurations according to the above-descried embodiments are not limited thereto. This disclosure achieves the following aspects effectively.

Aspect 1.

In Aspect 1, a sheet conveying device (for example, the sheet conveying device 200) includes a first sheet conveyance passage (for example, the regular sheet conveyance passage R1), a second sheet conveyance passage (for example, the bypass sheet conveyance passage R2) different from the first sheet conveyance passage, a pair of sheet conveying rollers (for example, the pair of relay rollers 42), and a movable member (for example, the bypass bottom plate 34, the bypass sheet feed roller 32). The pair of sheet conveying rollers includes two rollers (for example, the relay drive roller 42*a* and the relay driven roller 42*b*) configured to hold a sheet (for example, the recording sheet S) passing the first sheet conveyance passage. The movable member is configured to convey the sheet passing the second sheet conveyance passage. The two rollers are configured to be separated from each other along with movement of the movable member.

In Aspect 1, the two rollers of the pair of sheet conveying rollers in the first sheet conveyance passage are separated from each other in synchrony with movement of the movable member used for sheet conveyance in the second sheet conveyance passage. The sheet conveying device according to Aspect 1 has the configuration to convey the sheet in a selected sheet conveyance passage among a plurality of sheet conveyance passages including the first sheet conveyance passage and the second sheet conveyance passage. Therefore, when the sheet is conveyed in the selected sheet conveyance passage, the plurality of sheet conveyance passages other than the selected sheet conveyance passage are not used as an active sheet conveyance passage. Accordingly, when separating the two rollers of the pair of sheet conveying rollers in response to occurrence of paper jam while the sheet is conveyed in the first sheet conveyance passage, even if the movable member that is used for conveying the sheet in the second sheet conveyance passage is moved, conveyance of the sheet in the first sheet conveyance passage or paper jam handling (for example, removal of the sheet remaining in an image forming apparatus) is not hindered.

According to Aspect 1, since the two rollers of the pair of sheet conveying rollers in the first sheet conveyance passage are separated from each other in response to movement of the movable member used for conveying the sheet in the second sheet conveyance passage, the present embodiment achieves a simple configuration without a dedicated moving unit that separates the two rollers of the pair of sheet conveying rollers from each other. Accordingly, Aspect 1 easily achieves a simple configuration that does not include a dedicated moving unit achieves a highly convenient structure without a user operation to separate the two rollers of the pair of sheet conveying rollers.

Aspect 2.

In Aspect 2, the sheet conveying device (for example, the sheet conveying device 200) according to Aspect 1 further includes a tray (for example, the bypass tray 31) on which the sheet (for example, the recording sheet S) is loaded. The movable member (for example, the bypass bottom plate 34, the bypass sheet feed roller 32) is configured to move to convey the sheet on the tray to the second sheet conveyance passage (for example, the bypass sheet conveyance passage R2).

According to this configuration, the two rollers (for example, the relay drive roller 42*a* and the relay driven roller 42*b*) of the pair of sheet conveying rollers (for example, the pair of relay rollers 42) are separated from each other in the first sheet conveyance passage (for example, the regular sheet conveyance passage R1) along with movement of the movable member (for example, the bypass bottom plate 34, the bypass sheet feed roller 32) to convey the sheet to the second sheet conveyance passage.

Aspect 3.

In Aspect 3, the sheet conveying device (for example, the sheet conveying device 200) according to Aspect 2 further includes a sheet feed roller (for example, the bypass sheet feed roller 32) configured to convey the sheet (for example, the recording sheet S). The movable member (for example, the bypass bottom plate 34) includes a bottom plate. The bottom plate is configured to move upward toward the sheet feed roller. The sheet feed roller is configured to convey the sheet with the bottom plate being in contact with the sheet feed roller.

In Aspect 3, when the tray (for example, the bypass sheet tray 31) is lifted to bring the sheet on the tray to be pressed against the sheet feed roller, the two rollers of the pair of sheet conveying rollers in the first sheet conveyance passage (for example, the regular sheet conveyance passage R1) separate from each other. No sheet remains in the second sheet conveyance passage (for example, the bypass sheet conveyance passage R2) when a remaining sheet is removed from the first sheet conveyance passage. Therefore, when the two rollers of the pair of sheet conveying rollers in the first sheet conveyance passage are separated to remove the remaining sheet from the first sheet conveyance passage, even if the sheet on the tray on the side of the second sheet conveyance passage is pressed against the sheet feed roller, conveyance of the sheet or paper jam handling (for example, removal of the sheet remaining in an image forming apparatus) is not hindered.

Aspect 4.

In Aspect 4, the sheet conveying device (for example, the sheet conveying device 200) according to Aspect 2 further includes a sheet feed roller (for example, the bypass sheet feed roller 32) configured to convey the sheet (for example, the recording sheet S). The sheet feed roller is configured to move downward toward the sheet to convey the sheet in contact with the sheet feed roller.

In Aspect 4, when the sheet feed roller is lowered to bring the sheet on the tray (for example, the bypass sheet tray 31) to be pressed against the sheet feed roller, the two rollers of the pair of sheet conveying rollers in the first sheet conveyance passage (for example, the regular sheet conveyance passage R1) separate from each other. No sheet remains in the second sheet conveyance passage (for example, the bypass sheet conveyance passage R2) when a remaining sheet is removed from the first sheet conveyance passage. Therefore, when the two rollers (for example, the relay drive roller 42*a* and the relay driven roller 42*b*) of the pair of sheet conveying rollers (for example, the pair of relay rollers 42) in the first sheet conveyance passage are separated to remove the remaining sheet from the first sheet conveyance passage, even if the sheet feed roller on the side of the second sheet conveyance passage is pressed against the sheet on the tray, conveyance of the sheet or paper jam handling (for example, removal of the sheet remaining in an image forming apparatus) is not hindered.

Aspect 5.

In Aspect 5, the sheet conveying device (for example, the sheet conveying device 200) according to Aspect 1 further includes a rotary shaft (for example, the bypass bottom plate cam shaft 65) and a roller support (for example, the slide lever 38). The roller support is configured to support one of the two rollers (the relay driven roller 42*b*) of the pair of sheet conveying rollers (for example, the pair of relay rollers 42). The rotary shaft is configured to rotate to move the movable member (for example, the bypass bottom plate 34, the bypass sheet feed roller 32). As the roller support rotates along with movement of the movable member, the two rollers are separated from each other.

Accordingly, Aspect 5 easily achieves a simple configuration to separate the two rollers of the pair of sheet conveying rollers in the first sheet conveyance passage in synchrony with movement of the movable member used for sheet conveyance in the second sheet conveyance passage.

Aspect 6.

In Aspect 6 according to Aspect 5, the rotary shaft (for example, the bypass bottom plate cam shaft 65) has a pressing portion (for example, the pressing portion 65*e*) configured to face an opening (for example, the slide hole 38*a*) of the roller support (for example, the slide lever 38). The rotary shaft is configured to press the pressing portion of the rotary shaft against a pressing target portion (for example, the inner wall of the slide hole 38*a*) of the roller support in a direction in which the two rollers (for example, the relay drive roller 42*a* and the relay driven roller 42*b*) of the pair of sheet conveying rollers (for example, the pair of relay rollers 42) separates from each other.

Accordingly, Aspect 6 easily achieves a simple configuration to move the roller support along with rotation of the rotary shaft.

Aspect 7.

In Aspect 7 according to any one of Aspects 1 to 6, the second sheet conveyance passage is a bypass sheet conveyance passage (for example, the bypass sheet conveyance passage R2).

Accordingly, movement of the movable member (for example, the bypass bottom plate 34, the bypass sheet feed roller 32) in the bypass sheet conveyance passage is used to separate the two rollers (for example, the relay drive roller 42*a* and the relay driven roller 42*b*) of the pair of sheet conveying rollers (for example, the pair of relay rollers 42) in an image forming apparatus (for example, the image forming apparatus 1000) to remove the sheet (for example, the recording sheet S) remaining in the image forming apparatus.

Aspect 8.

In Aspect 8 according to any one of Aspects 1 to 7, wherein the movable member (for example, the bypass bottom plate 34) is configured to move when a device error (paper jam) occurs to the sheet (for example, the recording sheet S) passing the first sheet conveyance passage (for example, the regular sheet conveyance passage R1).

According to this configuration, the sheet conveying device having a highly convenient configuration is achieved easily for handling a device error such as paper jam when occurred to the sheet passing the first sheet conveyance passage.

Aspect 9.

In Aspect 9, an image forming apparatus (for example, the image forming apparatus 1000) includes an image forming device (for example, the photoconductor 1 and the image forming units)) configured to form an image on a sheet (for example, the recording sheet S), and the sheet conveying device (for example, the sheet conveying device 200) according to any one of Aspects 1 to 8, configured to convey the sheet to the image forming device.

According to this configuration, the image forming apparatus having a highly convenient configuration is achieved easily for separating the two rollers of the pair of sheet conveying rollers.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a first sheet conveyance passage connected to a first sheet source;

a second sheet conveyance passage different from the first sheet conveyance passage connected to a second sheet source which is different from the first sheet source;

a pair of sheet conveying rollers including two rollers to hold a sheet passing the first sheet conveyance passage without contacting sheets that are passing through the second conveyance passage; and a movable structure that is a plate or a roller different from the two rollers and that contacts the sheet at the second sheet conveyance passage, wherein the two rollers are separated from each other along with movement of the movable structure, the sheet conveying device further comprising:

a rotary shaft; and a roller support to support one of the two rollers, wherein the rotary shaft is to rotate to move the movable structure, and wherein, as the roller support moves along with the movement of the movable structure, the two rollers are separated from each other.

2. The sheet conveying device according to claim 1, further comprising a tray on which the sheet is loaded, wherein the movable structure is at a first position when there is conveying of the sheet on the tray to the second sheet conveyance passage, and the movable structure is at a second position, different from the first position, when there is a sheet passing through the first sheet conveyance passage.

3. The sheet conveying device according to claim 1, further comprising a sheet feed roller to convey the sheet, wherein the movable structure includes the plate which is a bottom plate, wherein the bottom plate is to move upward toward the sheet feed roller, and wherein the sheet feed roller is to convey the sheet with the bottom plate being in contact with the sheet feed roller.

4. The sheet conveying device according to claim 2, wherein the movable structure includes the roller which is a sheet feed roller to convey the sheet, wherein the sheet feed roller is to move downward toward the sheet to convey the sheet with the sheet being in contact with the sheet feed roller.

5. The sheet conveying device according to claim 1, wherein the rotary shaft has a pressing portion to face an opening of the roller support, and wherein the rotary shaft is to press the pressing portion against a pressing target portion of the roller support in a direction to separate the two rollers from each other.

6. The sheet conveying device according to claim 1, wherein the second sheet conveyance passage is a bypass sheet conveyance passage.

7. The sheet conveying device according to claim 1, wherein the movable structure is to move when an error occurs to the sheet passing the first sheet conveyance passage.

8. An image forming apparatus comprising:

an image forming device to form an image on a sheet; and the sheet conveying device according to claim 1, to convey the sheet to the image forming device.

9. The sheet conveying device according to claim 1, wherein the two rollers are separated from each other whenever the movable structure is in a position that does not permit the roller to convey the sheet.

10. A sheet conveying device comprising:

a first sheet conveyance passage;

a second sheet conveyance passage different from the first sheet conveyance passage;

a pair of sheet conveying rollers including two rollers to hold a sheet passing the first sheet conveyance passage; and a movable roller for conveying the sheet passing through the second sheet conveyance passage, wherein the sheet conveying rollers are separate from each other whenever the movable roller is in a position to convey the sheet, and the sheet conveying rollers are urged against each other whenever the movable roller is in a position not to convey the sheet, the sheet conveying device further comprising:

a rotary shaft; and a roller support to support one of the two rollers, wherein the rotary shaft is to rotate to move the movable roller, and wherein, as the roller support moves along with the movement of the movable roller, the two rollers are separated from each other.

11. A sheet conveying device comprising:

a first sheet conveyance passage;

a second sheet conveyance passage different from the first sheet conveyance passage;

a pair of sheet conveying rollers including two rollers to hold a sheet passing the first sheet conveyance passage; and a movable plate opposing a conveyance roller which conveys the sheet passing through the second sheet conveyance passage, wherein the sheet conveying rollers are separate from each other whenever the movable plate is in a position to convey the sheet using the conveyance roller, and the sheet conveying rollers are urged against each other whenever the movable plate is in a position such that the conveyance roller does not to convey the sheet, the sheet conveying device further comprising:

a rotary shaft; and a roller support to support one of the two rollers, wherein the rotary shaft is to rotate to move the movable plate, and wherein, as the roller support moves along with the movement of the movable plate, the two rollers are separated from each other.

* * * * *